US012473622B2

(12) United States Patent
Yoshida et al.

(10) Patent No.: US 12,473,622 B2
(45) Date of Patent: Nov. 18, 2025

(54) STEEL SHEET, METHOD FOR MANUFACTURING SAME AND PLATED STEEL SHEET

(71) Applicant: NIPPON STEEL CORPORATION, Tokyo (JP)

(72) Inventors: Mitsuru Yoshida, Tokyo (JP); Nobusato Kojima, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 778 days.

(21) Appl. No.: 17/297,697

(22) PCT Filed: Mar. 3, 2020

(86) PCT No.: PCT/JP2020/008888
§ 371 (c)(1),
(2) Date: May 27, 2021

(87) PCT Pub. No.: WO2020/195605
PCT Pub. Date: Oct. 1, 2020

(65) Prior Publication Data

US 2022/0025499 A1 Jan. 27, 2022

(30) Foreign Application Priority Data

Mar. 26, 2019 (JP) ..... 2019-059420

(51) Int. Cl.

| | |
|---|---|
| ***C22C 38/58*** | (2006.01) |
| ***C21D 8/02*** | (2006.01) |
| ***C22C 38/00*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/54*** | (2006.01) |
| ***C23C 2/02*** | (2006.01) |

(52) U.S. Cl.
CPC ..... *C22C 38/58* (2013.01); *C21D 8/0226* (2013.01); *C22C 38/001* (2013.01); *C22C 38/002* (2013.01); *C22C 38/005* (2013.01); *C22C 38/42* (2013.01); *C22C 38/44* (2013.01); *C22C 38/46* (2013.01); *C22C 38/48* (2013.01); *C22C 38/54* (2013.01); *C23C 2/02* (2013.01); *C23C 2/0224* (2022.08); *C21D 2211/001* (2013.01); *C21D 2211/005* (2013.01); *C21D 2211/008* (2013.01); *C21D 2211/009* (2013.01)

(58) Field of Classification Search
CPC .. C21D 8/0226; C21D 2211/008; C21D 1/18; C21D 2211/002; C21D 8/0263; C22C 38/42; C22C 38/44; C22C 38/46; C22C 38/48; C22C 38/54
See application file for complete search history.

(56) References Cited

U.S. PATENT DOCUMENTS

| | | | | |
|---|---|---|---|---|
| 2008/0223491 | A1 | 9/2008 | Kimijima | |
| 2010/0108201 | A1 | 5/2010 | Yokoi et al. | |
| 2013/0000791 | A1* | 1/2013 | Takahashi | C22C 38/06 148/507 |
| 2014/0000765 | A1 | 1/2014 | Nozaki et al. | |
| 2014/0030546 | A1 | 1/2014 | Suwa et al. | |
| 2014/0110022 | A1 | 4/2014 | Sano et al. | |
| 2014/0124101 | A1 | 5/2014 | Suwa et al. | |
| 2015/0017471 | A1* | 1/2015 | Shuto | C23C 2/024 148/333 |
| 2016/0076124 | A1 | 3/2016 | Yamazaki et al. | |
| 2019/0241996 | A1 | 8/2019 | Sano et al. | |
| 2021/0140005 | A1 | 5/2021 | Yoshida et al. | |

FOREIGN PATENT DOCUMENTS

| | | | |
|---|---|---|---|
| JP | 2008-255484 | A | 10/2008 |
| JP | 2009-84648 | A | 4/2009 |
| JP | 2012-1775 | A | 1/2012 |
| JP | 2012-1776 | A | 1/2012 |
| JP | 2014-205890 | A | 10/2014 |
| RU | 2 574 539 | C2 | 2/2016 |
| WO | WO 2008/123366 | A1 | 10/2008 |
| WO | WO 2012/133563 | A1 | 10/2012 |
| WO | WO 2012/141263 | A1 | 10/2012 |
| WO | WO 2012/161248 | A1 | 11/2012 |
| WO | WO 2013/103125 | A1 | 7/2013 |
| WO | WO 2018/026016 | A1 | 2/2018 |
| WO | WO 2019/009410 | A1 | 1/2019 |

OTHER PUBLICATIONS

D. L. Jordan and J. L. Tardiff, Automotive Body Corrosion, 2006, ASM International, Corrosion: Environments and Industries, vol. 13C, ASM Handbook, pp. 515-518 (Year: 2006).*
Tsuchiyama, "Physical Meaning of Tempering Parameter and Its Application for Continuous Heating or Cooling Heat Treatment Process", Heat Treatment, 2002, vol. 42, No. 3, pp. 163-168.

* cited by examiner

*Primary Examiner* — Anthony M Liang
(74) *Attorney, Agent, or Firm* — Birch, Stewart, Kolasch & Birch, LLP

(57) ABSTRACT

This steel sheet has a predetermined chemical composition and the steel sheet in which, at a ¼ depth position of a sheet thickness from a surface, an average grain size is 15.0 μm or less, a total grain boundary number density of solute C and solute B is 1.0 solute/nm$^2$ or more and 12.0 solutes/nm$^2$ or less, a total of pole densities of {211}<011> and {332}<113> in a thickness middle portion is 12.0 or less, and a tensile strength is 780 MPa or more is adopted.

10 Claims, No Drawings

STEEL SHEET, METHOD FOR MANUFACTURING SAME AND PLATED STEEL SHEET

TECHNICAL FIELD OF THE INVENTION

The present invention relates to a steel sheet, a method for manufacturing the same, and a plated steel sheet. In more detail, the present invention relates to a steel sheet having excellent workability that is preferred as a material used for applications such as cars, home appliances, mechanical structures, and construction, a method for manufacturing the same, and a plated steel sheet.

Priority is claimed on Japanese Patent Application No. 2019-059420, filed in Japan on Mar. 26, 2019, the content of which is incorporated herein by reference.

RELATED ART

For steel sheets provided as a material for structural members of transportation machines including cars or a variety of industrial machines, a variety of characteristics such as workability such as strength, elongation, or stretch flangeability, low temperature toughness, or uniformity of those characteristics are demanded.

Particularly, for steel sheets used for components such as an inner sheet member, a structural member, and a suspension member of a car, stretch flangeability, burring workability, ductility, fatigue durability, impact resistance, corrosion resistance, and the like are demanded depending on the applications. For steel sheets used for the above-described members, there is a demand for exhibiting the above-described material characteristics and a high strength in a high-dimensional and well-balanced manner.

In addition, steel sheets used for the above-described members need to have a characteristic not allowing the steel sheets to be easily broken even when impacted by collision after being formed and attached to a car as a component of a member. Particularly, in cold climates in which steel sheets are used at a low temperature, members become likely to embrittle, and thus there is also a need for improving the low temperature toughness of the steel sheets in order to ensure impact resistance.

The low temperature toughness is a characteristic prescribed by vTrs (Charpy fracture appearance transition temperature) or the like. For thin steel sheets used for a component of the above-described members, not only excellent workability but also low temperature toughness are demanded as extremely important characteristics. Furthermore, there is a case where defects and micro cracking are caused on sheared cross sections or punched end surfaces formed in forming steps of components. When defects and cracks are caused on sheared cross sections or punched end surfaces, there is a case where crack propagate from the defects and the cracking to cause fatigue fracture. Therefore, there is a demand for suppressing defects and cracking caused on sheared cross sections or punched end surfaces from the viewpoint of fatigue durability. As defects and micro cracking caused on sheared cross sections and punched end surfaces, for example, cracking that is caused parallel to the sheet thickness direction of end surfaces as described in Patent Document 1 is known, and such cracking is referred to as "peeling".

As a steel sheet from which excellent ductility can be obtained, a Dual Phase steel sheet (hereinafter, DP steel) configured of a composite structure of soft ferrite and full-hard martensite is known. DP steel is excellent in terms of ductility, but is cracked due to the generation of voids in the interface between ferrite and martensite which have significantly different hardness and is thus poor in terms of hole expansibility in some cases.

Patent Document 2 proposes a high strength hot rolled steel sheet having a tensile strength of 980 MPa or more in which the area fractions of bainitic ferrite, martensite, and bainite are each set to 90% or more, 5% or less, and 5% or less, thereby improving elongation and hole expansibility (stretch flangeability). However, in the invention described in Patent Document 2, there is a case where sufficient elongation cannot be obtained since bainitic ferrite is a main body.

Patent Document 3 proposes a hot rolled steel sheet having a tensile strength of 980 MPa or more in which the area fraction of bainite is set to 90% or more to configure the remainder with one or more primary phase structures selected from martensite, austenite, and ferrite and to control the amount and the average grain size of cementite that is dispersed in the structure, thereby improving hole expansibility (stretch flangeability). However, in the invention described in Patent Document 3, since the hot rolled steel sheet is coiled at 330° C. to 470° C., which is a transition boiling region, there is a case where a characteristics unevenness is caused due to a temperature unevenness in the sheet surface.

Patent Document 4 proposes a hot rolled steel sheet having excellent fatigue properties in which a ferrite fraction is 50% to 95%, a fraction of a full-hard second phase made up of martensite and residual austenite is 5% to 50%, the interrelationship between the amounts of carbide-forming elements or the relationship between the carbide-forming element and the amount of C is set in a predetermined range, thereby prescribing the average grain size of a precipitate and the fraction of the precipitate. However, in the invention described in Patent Document 4, since the strength is ensured by the precipitation hardening of a fine carbide using soft ferrite as a main body, there is a case where sufficient low temperature toughness cannot be obtained.

Patent Document 5 proposes a steel sheet in which the proportion of grains containing 0 to 30% of ferrite and 70 to 100% of bainite and having a crystal orientation difference in the grains of 5° to 14° in all grains is set within a specific range to prescribe the grain boundary number density of solute C or the total of solute C and solute B and the average grain size of cementite that is precipitated in grain boundaries, the stretch flangeability is excellent, and peeling occurs to a small extent. However, in Patent Document 5, low temperature toughness necessary for impact resistance is not taken into account.

PRIOR ART DOCUMENT

Patent Document

[Patent Document 1] PCT International Publication No. WO2008/123366

[Patent Document 2] Japanese Unexamined Patent Application, First Publication No. 2008-255484

[Patent Document 3] Japanese Unexamined Patent Application, First Publication No. 2014-205890

[Patent Document 4] Japanese Unexamined Patent Application, First Publication No. 2009-84648

[Patent Document 5] PCT International Publication No. WO2018/026016

Non-Patent Document

[Non-Patent Document 1] Tsuchiyama, T (2002). 'Physical Meaning of Tempering Parameter and Its Application for Continuous Heating or Cooling Heat Treatment Process', Heat Treatment (3rd ed., Vol. 42) pp. 163-168

DISCLOSURE OF THE INVENTION

Problems to be Solved by the Invention

The present invention has been made in consideration of the above-described problems, and an object of the present invention is to provide a steel sheet having a high strength and being excellent in terms of elongation, stretch flangeability, low temperature toughness, and peeling resistance, a method for manufacturing the same, and a plated steel sheet having a variety of characteristics described above.

Means for Solving the Problem

The present inventors found that it is possible to manufacture a steel sheet having a high strength and being excellent in terms of elongation, stretch flangeability, low temperature toughness, and peeling resistance by controlling the texture and microstructure of the steel sheet through the optimization of the chemical composition and manufacturing conditions of the steel sheet. It should be noted that excellent peeling resistance refers to the fact that defects and cracking are caused on sheared cross sections or punched end surfaces to a small extent.

The gist of the present invention is as described below.

[1] A steel sheet according to an aspect of the present invention having a chemical composition containing, by mass %:

C: 0.02% to 0.15%,
Si: 0.005% to 2.000%,
Mn: 1.00% to 3.00%,
Ti: 0.010% to 0.200%,
sol. Al: 0.001% to 1.000%,
N: 0.0010% to 0.0100%,
P: 0.100% or less,
S: 0.0100% or less,
Nb: 0% to 0.100%,
V: 0% to 0.500%,
Mo: 0% to 0.500%,
Cu: 0% to 1.00%,
Ni: 0% to 1.00%,
Cr: 0% to 2.00%,
B: 0% to 0.0020%,
Ca: 0% to 0.0100%,
Mg: 0% to 0.0100%,
REM: 0% to 0.0300%, and
Bi: 0% to 0.0200% with a remainder comprising Fe and an impurity, in which at a ¼ depth position of a sheet thickness from a surface, a total area fraction of tempered martensite and tempered bainite is 10% or more and 100% or less, an area fraction of ferrite is 0% or more and 90% or less, an area fraction of residual austenite is 0% or more and less than 4%, a total area fraction of the residual austenite, fresh martensite, cementite, and pearlite is 0% or more and 10% or less, an average grain size is 15.0 μm or less, a total grain boundary number density of solute C and solute B is 1.0 solute/$nm^2$ or more and 12.0 solutes/$nm^2$ or less, a total of pole densities of {211}<011> and {332}<113> in a thickness middle portion is 12.0 or less, and a tensile strength is 780 MPa or more.

[2] The steel sheet according to [1], in which the chemical composition may contain, by mass %, one or more selected from the group consisting of Nb: 0.001% to 0.100%,
V: 0.005% to 0.500%,
Mo: 0.001% to 0.500%,
Cu: 0.02% to 1.00%,
Ni: 0.02% to 1.00%,
Cr: 0.02% to 2.00%,
B: 0.0001% to 0.00200%,
Ca: 0.0002% to 0.0100%,
Mg: 0.0002% to 0.0100%,
REM: 0.0002% to 0.0100%, and
Bi: 0.0001% to 0.0200%.

[3] A method for manufacturing a steel sheet according to another aspect of the present invention is a method for manufacturing the steel sheet according to [1] or [2], having a step of performing multi-pass hot rolling on a slab or steel piece having the chemical composition according to [1] or [2] and a step of performing a heat treatment, in which, in the step of performing multi-pass hot rolling, a heating temperature is set to 1200° C. to 1350° C., when a finish temperature is expressed as FT in a unit of ° C., a total rolling reduction in a temperature range of higher than the FT+50° C. and the FT+150° C. or lower is set to 50% or more, a total rolling reduction within a temperature range of from the FT to the FT+50° C. is set to 40% to 80%, a time necessary for rolling within the temperature range of from the FT to the FT+50° C. is set to 0.5 to 10.0 seconds, two or more passes of rolling are performed in each of the temperature range of higher than the FT+50° C. and the FT+150° C. or lower and the temperature range of from the FT to the FT+50° C., an average cooling rate within a temperature range of from the FT to the FT+100° C. is set to 6.0° C./sec or faster, finish rolling is completed with the FT set to equal to or higher than Ars that is obtained from Expression (1) and set to equal to or higher than TR that is obtained from Expression (2) and 1100° C. or lower, then, water cooling is initiated within 3.0 seconds, cooling is performed by setting an average cooling rate within a temperature range of from the FT to 750° C. to 30° C./sec or faster, retaining the slab or steel piece within a temperature range of from 750° C. to 600° C. for 20 seconds or shorter, and then setting an average cooling rate within a temperature range of from a cooling stop temperature of 600° C. to lower than Ms-200° C. to 30° C./sec or faster, in the step of performing the heat treatment, a maximum attainment temperature Tmax during the heat treatment is set to 300° C. to 720° C., and a tempering parameter Ps is set to 14.6×Tmax+5891 or more and 17.1×Tmax+6223 or less.

$$Ar_3\ (C)=901-325\times[C]+33\times[Si]-92\times[Mn]+287\times[P]+40\times[sol.\ Al] \quad (1)$$

$$TR\ (°\ C.)=800+700\times[Ti]+1000\times[Nb] \quad (2)$$

Here, each element symbol in Expression (1) and Expression (2) indicates an amount of each element by mass %, and zero is assigned in a case where the element is not contained.

[4] In the method for manufacturing a steel sheet according to [3], an average cooling rate within a temperature range of from the cooling stop temperature of Ms that is obtained from Expression (3) to lower than Ms-200° C. may be set to 80° C./sec or faster.

Ms (° C.)=561-474×[C]-33×[Mn]-17×[Ni]-21×[Mo] (3)

Here, each element symbol in Expression (3) indicates an amount of each element by mass %.

[5] In the method for manufacturing a steel sheet according to [3] or [4], the water cooling may be initiated within 0.3 seconds after completion of the finish rolling, and cooling in which an average cooling rate within a temperature range of from the FT to the FT−40° C. is 100° C./sec or faster may be performed.

[6] In the method for manufacturing a steel sheet according to [5], a step of performing cooling in which an average cooling rate within a temperature range from the FT to the FT−40° C. is 100° C./sec or faster may be performed between the rolling stands.

[7] A plated steel sheet according to still another aspect of the present invention, including the steel sheet according to [1] or [2] and a plating layer formed on a surface of the steel sheet.

[8] In the plated steel sheet according to [7], the plated layer may be a hot-dip galvanized layer.

[9] In the plated steel sheet according to [7], the plated layer may be a hot-dip galvannealed layer.

Effects of the Invention

According to the aspects of the present invention, it is possible to provide a steel sheet having a high strength and being excellent in terms of elongation, stretch flangeability, low temperature toughness, and peeling resistance, a method for manufacturing the same, and a plated steel sheet having a variety of characteristics described above. When the steel sheet or plated steel sheet according to the present invention is used as a material of a component for an inner plate member, a structural member, a suspension member, or the like of a car, it is easy to work the steel sheet or plated steel sheet into a component shape, and the steel sheet or plated steel sheet is capable of withstanding the use in an extremely cold climate, and thus industrial contribution is extremely significant.

EMBODIMENTS OF THE INVENTION

A steel sheet, a method for manufacturing a steel sheet, and a plated steel sheet according to the present embodiment will be described below in detail. First, the chemical composition of the steel sheet according to the present embodiment will be described. However, the present invention is not limited only to a configuration disclosed in the present embodiment and can be modified in a variety of manners within the scope of the gist of the present invention.

Numerical limiting ranges described below using "to" include the lower limit value and the upper limit value in the ranges. Numerical values expressed with 'more than' or 'less than' are not included in numerical ranges. In the following description, "%" regarding the chemical composition of steel indicates "mass %" in all cases.

<Chemical Composition of Steel>

(C: 0.02% to 0.15%)

C bonds to a full-hard phase such as tempered martensite or tempered bainite, Ti, or the like to generate a carbide, thereby increasing the strength of steel. In addition, C segregates at grain boundaries and suppresses the peeling of end surfaces formed by punching or shearing, thereby improving the peeling resistance. When the amount of C is less than 0.02%, it is difficult to sufficiently exhibit the above-described action. Therefore, the amount of C is set to 0.02% or more and preferably set to 0.03% or more. On the other hand, when the amount of C is more than 0.15%, the stretch flangeability and low temperature toughness of the steel sheet deteriorates. In addition, ferritic transformation after hot rolling is significantly delayed, and it becomes difficult to obtain a desired amount of ferrite. Furthermore, the weldability significantly deteriorates. Therefore, the amount of C is set to 0.15% or less. The amount of C is preferably 0.12% or less and more preferably 0.10% or less.

(Si: 0.005% to 2.000%)

Si has an action of increasing the strength of steel by solid solution strengthening and the enhancement of hardenability. In addition, Si also has an effect of suppressing the precipitation of cementite. When the amount of Si is less than 0.005%, it becomes difficult to exhibit the above-described action. Therefore, the amount of Si is set to 0.005% or more. The amount of Si is preferably 0.010% or more, more preferably 0.100% or more, and still more preferably 0.300% or more. On the other hand, when the amount of Si is more than 2.000%, the surface properties of the steel sheet significantly deteriorate due to surface oxidation in a hot rolling step. Therefore, the amount of Si is set to 2.000% or less. The amount of Si is preferably 1.500% or less and more preferably 1.300% or less.

(Mn: 1.00% to 3.00%)

Mn has an action of increasing the strength of steel by solid solution strengthening and the enhancement of hardenability.

When the amount of Mn is less than 1.00%, it becomes difficult to obtain a strength of the steel sheet of 780 MPa or more. Therefore, the amount of Mn is set to 1.00% or more. The amount of Mn is preferably 1.20% or more. On the other hand, when the amount of Mn is more than 3.00%, ferritic transformation in a cooling process after hot rolling is excessively delayed, and thus it becomes difficult to obtain a desired amount of ferrite. In addition, due to the hardening of fresh martensite and bainite, a crack is easily generated in the vicinity of the boundary between fresh martensite and bainite and soft ferrite, and thus the stretch flangeability and toughness of the steel sheet degrade.

The present inventors found that, when a large amount of Mn is contained, there is a case where the stretch flangeability degrades together with an increase in the in-plane anisotropy of the r value of the steel sheet. The reason therefor is not clear, but is assumed to result from the precipitation of a large amount of MnS attributed to a large amount of Mn contained and recrystallization during hot rolling that is attributed to Mn segregation or the generation of a local unevenness in ferritic transformation after finish rolling. Based on the above description, the amount of Mn is set to 3.00% or less in order to obtain a desired amount of ferrite and stably manufacture a steel sheet having excellent stretch flangeability. The amount of Mn is preferably 2.50% or less, more preferably 2.20% or less, and still more preferably 1.80% or less.

(Ti: 0.010% to 0.200%)

Ti has an action of refining the metallographic structure by forming a Ti nitride. In addition, Ti has an action of strengthening steel by precipitating a carbide. When the amount of Ti is less than 0.010%, it becomes difficult to exhibit the above-described actions. Therefore, the amount of Ti is set to 0.010% or more. The amount of Ti is preferably 0.030% or more, more preferably 0.040% or more, and still more preferably 0.060% or more. On the other hand, when Ti is excessively contained, a coarse nitride or carbide is generated, and thus the stretch flangeability and toughness of the steel sheet degrade. Furthermore, since Ti also has an action of increasing the recrystallization temperature of austenite, when Ti is excessively contained, the recrystallization temperature becomes excessively high, and the anisotropy of the r value increases, and thus the stretch flangeability of the steel sheet degrades. Therefore, the amount of Ti is set to 0.200% or less. The amount of Ti is preferably 0.160% or less and more preferably 0.140% or less.

(sol. Al: 0.001% to 1.000%)

Al has an action of cleaning steel by deoxidation in a steelmaking stage (suppressing the generation of a defect such as a blow hole in steel) and promoting ferritic transformation. When the amount of sol. Al is less than 0.001%, it becomes difficult to exhibit the above-described action. Therefore, the amount of sol. Al is set to 0.001% or more. The amount of sol. Al is preferably 0.010% or more and more preferably 0.020% or more. On the other hand, when the amount of sol. Al is set to more than 1.000%, the effect of the above-described action is saturated, and an increase in the refining cost is caused. Therefore, the amount of sol. Al is set to 1.000% or less. The amount of sol. Al is preferably 0.800% or less and more preferably 0.600% or less. It should be noted that sol. Al refers to acid-soluble Al.

(N: 0.0010% to 0.0100%)

N has an action of refining the microstructure by forming a Ti nitride to suppress the coarsening of austenite during the reheating and hot rolling of slabs. When the amount of N is less than 0.0010%, it becomes difficult to exhibit the above-described action. Therefore, the amount of N is set to 0.0010% or more. The amount of N is preferably 0.0015% or more and more preferably 0.0020% or more. On the other hand, when the amount of N is more than 0.0100%, a coarse Ti nitride is formed, and the stretch flangeability of the steel sheet deteriorates. Therefore, the amount of N is set to 0.0100% or less. The amount of N is preferably 0.0060% or less and more preferably 0.0050% or less.

(P: 0.100% or Less)

P is an element that is contained in steel as an impurity and has an action of degrading the stretch flangeability or low temperature toughness of the steel sheet. Therefore, the amount of P is set to 0.100% or less. The amount of P is preferably 0.060% or less, more preferably 0.040% or less, and still more preferably 0.020% or less. P is incorporated from a raw material as an impurity, and the lower limit thereof does not need to be particularly limited, but the amount of P is preferably smaller as long as the stretch flangeability or the low temperature toughness is ensured. However, when the amount of P is excessively decreased, the manufacturing cost increases. From the viewpoint of the manufacturing cost, the amount of P is preferably 0.001% or more and more preferably 0.005% or more.

(S: 0.0100% or Less)

S is an element that is contained as an impurity and has an action of degrading the workability of the steel sheet.

Therefore, the amount of S is set to 0.0100% or less. The amount of S is preferably 0.0080% or less, more preferably 0.0060% or less, and still more preferably 0.0030% or less. S is incorporated from the raw material as an impurity, and the lower limit thereof does not need to be particularly limited, but the amount of S is preferably smaller from the viewpoint of ensuring workability. However, when the amount of S is excessively decreased, the manufacturing cost increases. From the viewpoint of the manufacturing cost, the amount of S is preferably 0.0001% or more, more preferably 0.0005% or more, and still more preferably 0.0010% or more.

The remainder of the chemical composition of the steel sheet according to the present embodiment is made up of Fe and an impurity. In the present embodiment, the impurity means an element that is allowed as long as the element does not adversely affect the steel sheet according to the present embodiment.

The steel sheet according to the present embodiment may contain the following arbitrary elements instead of some of Fe. Since the steel sheet according to the present embodiment is capable of achieving the object even when the arbitrary elements are not contained, the lower limit of the amount is 0% in a case where the arbitrary elements are not contained.

(Nb: 0% to 0.100%)

Nb is an arbitrary element. Nb has effects of suppressing the coarsening of the grain sizes of the steel sheet, refining ferrite grain sizes, and increasing the strength of the steel sheet by the precipitation hardening of NbC. In the case of reliably obtaining these effects, the amount of Nb is preferably set to 0.001% or more. The amount of Nb is more preferably 0.005% or more. On the other hand, when the amount of Nb exceeds 0.100%, the above-described effects are saturated, and there is a case where an increase in the rolling force during finish rolling is caused. Therefore, the amount of Nb is preferably set to 0.100% or less. The amount of Nb is preferably 0.060% or less and more preferably 0.030% or less.

(V: 0% to 0.500%)

V is an arbitrary element. V has effects of increasing the strength of the steel sheet by forming a solid solution in steel and also improving the strength of the steel sheet through precipitation hardening by being precipitated as a carbide, a nitride, a carbonitride, or the like in steel. In the case of reliably obtaining these effects, the amount of V is preferably set to 0.005% or more. The amount of V is more preferably 0.010% or more. On the other hand, when the amount of V exceeds 0.500%, there is a case where the degradation of the toughness of the steel sheet is caused. Therefore, the amount of V is preferably set to 0.500% or less. The amount of V is more preferably 0.300% or less.

(Mo: 0% to 0.500%)

Mo is an arbitrary element. Mo has effects of increasing the hardenability of steel and of the high-strengthening of the steel sheet by forming a carbide or a carbonitride. In the case of reliably obtaining these effects, the amount of Mo is preferably set to 0.001% or more. The amount of Mo is more preferably 0.005% or more. On the other hand, when the amount of Mo exceeds 0.500%, there is a case where the cracking sensitivity of slabs is enhanced. Therefore, the amount of Mo is preferably set to 0.500% or less. The amount of Mo is more preferably 0.300% or less.

(Cu: 0% to 1.00%)

Cu is an arbitrary element. Cu has an effect of improving the toughness of steel and an effect of increasing the strength. In the case of reliably obtaining these effects, the amount of Cu is preferably set to 0.02% or more. The amount of Cu is more preferably 0.08% or more. On the other hand, when Cu is excessively contained, there is a case where the weldability of the steel sheet degrades. Therefore, the amount of Cu is preferably set to 1.00% or less. The amount of Cu is more preferably 0.50% or less and still more preferably 0.30% or less.

(Ni: 0% to 1.00%)

Ni is an arbitrary element. Ni has an effect of improving the toughness of steel and an effect of increasing the strength. In the case of reliably obtaining these effects, the amount of Ni is preferably set to 0.02% or more. The amount of Ni is more preferably 0.10% or more. On the other hand, when Ni is excessively contained, the alloying cost is high, and there is a case where the toughness of a welded heat-affected zone in the steel sheet deteriorates. Therefore, the amount of Ni is preferably set to 1.00% or less. The amount of Ni is more preferably 0.50% or less and still more preferably 0.30% or less.

(Cr: 0% to 2.00%)

Cr is an arbitrary element. Cr has an effect of promoting the formation of fresh martensite or the like by enhancing the hardenability of steel. In the case of reliably obtaining this effect, the amount of Cr is preferably set to 0.02% or more. The amount of Cr is more preferably 0.05% or more. On the other hand, when Cr is excessively contained, ferritic transformation in the cooling process after hot rolling is excessively delayed, and thus there is a case where it becomes difficult to obtain a desired amount of ferrite. Therefore, the amount of Cr is preferably set to 2.00% or less. The amount of Cr is more preferably 1.50% or less, still more preferably 1.00% or less, and particularly preferably 0.50% or less.

(B: 0% to 0.0020%)

B is an arbitrary element. B has an action of improving the peeling resistance by increasing the grain boundary strength through segregation at grain boundaries. In the case of reliably obtaining this effect, the amount of B is preferably set to 0.0001% or more. The amount of B is more preferably 0.0002% or more. On the other hand, even when more than 0.0020% of B is contained, the above-described effect is saturated, and the alloying cost increases. Therefore, the amount of B is preferably set to 0.0020% or less. The amount of B is more preferably 0.0015% or less and still more preferably 0.0010% or less.

(Ca: 0% to 0.0100%)

Ca is an arbitrary element. Ca has an effect of dispersing a number of fine oxides in molten steel to refine the metallographic structure of the steel sheet. In addition, Ca has an effect of improving the stretch flangeability of the steel sheet by fixing S in molten steel as spherical CaS to suppress the generation of an elongated inclusion such as MnS. In the case of reliably obtaining these effects, the amount of Ca is preferably set to 0.0002% or more. The amount of Ca is more preferably 0.0005% or more. On the other hand, when the amount of Ca exceeds 0.0100%, CaO in steel increases, and there is a case where the toughness of the steel sheet is adversely affected. Therefore, the amount of Ca is preferably set to 0.0100% or less. The amount of Ca is more preferably 0.0050% or less and still more preferably 0.0030% or less.

(Mg: 0% to 0.0100%)

Mg is an arbitrary element. Similar to Ca, Mg has effects of suppressing the formation of coarse MnS by forming an oxide or a sulfide in molten steel and refining the structure of the steel sheet by dispersing a number of fine oxides. In the case of reliably obtaining these effects, the amount of Mg is preferably set to 0.0002% or more. The amount of Mg is more preferably 0.0005% or more. On the other hand, when the amount of Mg exceeds 0.0100%, an oxide in steel increases, and the toughness of the steel sheet is adversely affected. Therefore, the amount of Mg is preferably set to 0.0100% or less. The amount of Mg is more preferably 0.0050% or less and still more preferably 0.0030% or less.

(REM: 0% to 0.0100%)

REM is an arbitrary element. Similar to Ca, REM also has effects of suppressing the formation of coarse MnS by forming an oxide or a sulfide in molten steel and refining the structure of the steel sheet by dispersing a number of fine oxides. In the case of obtaining these effects, the amount of REM is preferably set to 0.0002% or more. The amount of REM is more preferably 0.0005% or more. On the other hand, when the amount of REM exceeds 0.0100%, an oxide in steel increases, and there is a case where the toughness of the steel sheet is adversely affected. Therefore, the amount of REM is preferably set to 0.0100% or less. The amount of REM is more preferably 0.0050% or less and still more preferably 0.0030% or less.

Here, REM (rare earth metal) refers to a total of 17 elements made up of Sc, Y, and lanthanoid. It should be noted that, in the present embodiment, the amount of REM refers to the total amount of these elements.

(Bi: 0% to 0.0200%)

Bi is an arbitrary element. Bi has an effect of improving the formability of the steel sheet by refining the solidification structure. In order to reliably obtain this effect, the amount of Bi is preferably set to 0.0001% or more. The amount of Bi is more preferably 0.0005% or more. On the other hand, when the amount of Bi exceeds 0.0200%, since the above-described effect is saturated, and the alloying cost increases, the amount of Bi is preferably set to 0.0200% or less. The amount of Bi is more preferably 0.0100% or less and still more preferably 0.0070% or less.

The above-described chemical composition of the steel sheet may be measured by an ordinary analytical method. For example, the chemical composition may be measured using inductively coupled plasma-atomic emission spectrometry (ICP-AES). It should be noted that C and S may be measured using an infrared absorption method after combustion and N may be measured using an inert gas melting-thermal conductivity method. In the case of providing a galvanized layer on the surface, the chemical composition may be analyzed after the galvanized layer on the surface is removed by mechanical grinding.

Next, the metallographic structures of the steel sheet will be described. In the steel sheet according to the present embodiment, at a ¼ depth position of the sheet thickness from the surface, the total area fraction of tempered martensite and tempered bainite is 10% or more and 100% or less, the area fraction of ferrite is 0% or more and 90% or less, the area fraction of residual austenite is 0% or more and less than 4%, the total area fraction of the residual austenite, fresh martensite, cementite, and pearlite is 0% or more and 10% or less, the average grain size is 15.0 μm or less, the total grain boundary number density of solute C and solute B is 1.0 solute/$nm^2$ or more and 12.0 solutes/$nm^2$ or less, and the total of pole densities of {211}<011> and {332}<113> in a thickness middle portion is 12.0 or less. Hereinafter, each requirement will be described in detail.

In the steel sheet according to the present embodiment, at a ¼ depth position of the sheet thickness from the surface of the steel sheet, the total area fraction of "tempered martensite and tempered bainite", the area fraction of residual austenite, the total area fraction of "the residual austenite, fresh martensite, cementite, and pearlite", the average grain size, and the total grain boundary number density of solute C and solute B are controlled within predetermined ranges. Here, the reason for prescribing the steel structure at the ¼ depth position of the sheet thickness from the surface of the steel sheet is that this depth position is the middle point between the surface of the steel sheet and the sheet thickness middle position and the steel structure at the position represents the steel structure of the steel sheet (indicates the average steel structure of the entire steel sheet) except for the texture.

(Total Area Fraction of Tempered Martensite and Tempered Bainite: 10% to 100%)

Tempered martensite and tempered bainite do not easily crack and are favorable in ductility and toughness compared with fresh martensite and bainite and are thus structures that are excellent in terms of strength, elongation, stretch flangeability, and low temperature toughness. Therefore, tempered martensite and tempered bainite are essential metallographic structures in the steel sheet according to the present embodiment. When the total area fraction of tempered martensite and tempered bainite is less than 10%, it becomes difficult to obtain a desired strength. Therefore, the total area fraction of tempered martensite and tempered bainite is set to 10% or more. The total area fraction is preferably 20% or more and more preferably 30% or more. Since a higher strength can be obtained, which is preferable, as the total area fraction of tempered martensite and tempered bainite increases, the total area fraction of these metallographic structures may be 100%.

(Area Fraction of Ferrite: 0% to 90%)

Ferrite may be contained in order to improve the balance between strength and ductility. When the area fraction of ferrite exceeds 90%, since it becomes difficult to obtain a desired strength, the area fraction of ferrite is set to 90% or less. The area fraction of ferrite is preferably less than 85%. Since the steel sheet according to the present embodiment is capable of achieving the object even when ferrite is not contained, the area fraction of ferrite may be 0%.

(Area Fraction of Residual Austenite: 0% or More and Less than 4%)

(Total Area Fraction of Residual Austenite, Fresh Martensite, Cementite, and Pearlite: 0% to 10%)

Residual austenite, fresh martensite, cementite, and pearlite serve as cracking starting points and degrade the stretch flangeability or low temperature toughness of the steel sheet. Therefore, the total area fraction of residual austenite, fresh martensite, cementite, and pearlite is set to 10% or less. The total area fraction is preferably 8% or less and more preferably 5% or less. Since the steel sheet according to the present embodiment is capable of achieving the object even when these metallographic structures are not contained, the area fraction of these metallographic structures may be 0%.

In addition, among these metallographic structures, residual austenite transforms into extremely full-hard fresh martensite by preliminary working such as punching and thus significantly deteriorates the stretch flangeability of the steel sheet. Therefore, the area fraction of residual austenite is set to less than 4%. The area fraction is preferably 3% or less, more preferably 2% or less, still more preferably less than 2%, and far still more preferably 1% or less. Since the area fraction of residual austenite is preferably as small as possible, the area fraction may be 0%.

(Average Grain Size: 15.0 μm or Less)

When the block diameters of tempered martensite and tempered bainite and the average grain size of ferrite are coarse, the fracture surface unit at the time of fracture becomes large, and the low temperature toughness of the steel sheet degrades. Therefore, the average grain size is set to 15.0 μm or less. The average grain size is preferably 12.0 μm or less, more preferably 10.0 μm or less, and still more preferably 7.0 μm or less. The average grain size is preferably as small as possible, and thus the lower limit is not particularly limited. However, it is technically difficult to refine grains by ordinary hot rolling such that the average grain size becomes smaller than 1.0 μm. Therefore, the average grain size may be 1.0 μm or more or 4.0 μm or more.

It should be noted that the average grain size in the present embodiment refers to the average value of grain sizes for which a region that is surrounded by grain boundaries having a crystal orientation difference of 15° or more and has a circle equivalent diameter of 0.3 μm or more in a material having a bcc crystal structure, that is, ferrite, tempered bainite, tempered martensite, fresh martensite, and pearlite is defined as a crystal grain, and the grain sizes of residual austenite and cementite are not included in the average grain size.

In the present embodiment, the average grain size and the area fraction of each structure are obtained for a structure at a ¼ depth position of the sheet thickness from the surface of the steel sheet on a cross section of the steel sheet parallel to a rolling direction and the sheet thickness direction.

The average grain size, the ferrite area fraction, and the residual austenite area fraction are obtained by scanning electron microscope (SEM) observation and electron back scattering diffraction (EBSD) analysis using an EBSD analyzer made up of a thermal electric field radiation scanning electron microscope and an EBSD detector. In a region that is 200 μm long in a rolling direction and 100 μm long in the sheet thickness direction with the ¼ depth position of the sheet thickness from the surface of the steel sheet as the center, crystal orientation information is acquired at 0.2 μm intervals while differentiating fcc and bcc. Grain boundaries having a crystal orientation difference of 15° or more are specified using the software attached to the EBSD analyzer ("OIM Analysis (registered trademark)" manufactured by AMETEK, Inc.). The average grain size of bcc is obtained by a method in which [Expression 1] is used by defining a region that is surrounded by grain boundaries having a crystal orientation difference of 15° or more and has a circle equivalent diameter of 0.3 μm or more as a crystal grain. In the expression, D represents the average grain size, N represents the number of crystal grains included in the evaluation region of the average grain size, Ai represents the area of an $i^{th}$ (i=1, 2, . . . , N) crystal grain, and di represents the circle equivalent diameter of the $i^{th}$ crystal grain.

[Expression 1]

$$D = \frac{\sum_{i=1}^{N} Ai \times di}{\sum_{i=1}^{N} Ai} \quad (1)$$

A grain boundary having a crystal orientation difference of 15° or more is mainly a ferrite grain boundary and a block boundary of tempered martensite and tempered bainite. In a method for measuring the ferrite grain sizes according to JIS G 0552:2013, there is a case where a grain size is computed even for a ferrite grain having a crystal orientation difference of less than 15°, and furthermore, a block of tempered martensite or tempered bainite is not computed. Therefore, as the average grain size in the present embodiment, a value obtained by EBSD analysis as described above is employed.

The area fraction of residual austenite is obtained by calculating the area fraction of a metallographic structure determined as fcc by EBSD analysis.

The area fraction of ferrite is obtained by defining a region that is surrounded by grain boundaries having a crystal orientation difference of 5° or more and having a circle equivalent diameter of 0.3 μm or more as a crystal grain and calculating the area fraction of, in the crystal grains, crystal grains having a GAM value, which is obtained by grain average misorientation analysis provided in OIM Analysis, of 0.5° or less. The reason for defining a boundary having a crystal orientation difference of 5° or more as a grain boundary at the time of obtaining the area fraction of ferrite is that there is a case where it is not possible to differentiate a different structure formed as a variant close to the same prior austenite grain.

The area fractions of pearlite and cementite are obtained by observing metallographic structures revealed by nital etching by SEM observation.

The area fraction of fresh martensite is obtained by obtaining the total area fraction of fresh martensite and residual austenite by observing martensite-ausutenite constituent (MA) revealed by LePera corrosion with an optical microscope and subtracting the area fraction of residual austenite obtained by the above-described method from this total area fraction.

The area fraction may be obtained by image analysis or may be obtained by a point calculation method. For example, for pearlite and cementite, the area fractions may be obtained by observing three or more visual fields (100 μm×100 μm/visual field) in a region at a ¼ depth position of the sheet thickness from the surface of the steel sheet at a magnification of 1000 times and calculating the area fraction by the point calculation method at lattice spacings of 5 μm. In addition, the total area fractions of fresh martensite and residual austenite may be obtained by observing two or more visual fields (200 μm×200 μm/visual field) in a region at a ¼ depth position of the sheet thickness from the surface of the steel sheet at a magnification of 500 times and calculating the area fraction by the point calculation method at lattice spacings of 5 μm.

The total area fraction of tempered martensite and tempered bainite is obtained by subtracting the total area fraction of ferrite, pearlite, residual austenite, cementite, and fresh martensite from 100%.

(Total Grain Boundary Number Density of Solute C and Solute B: 1.0 to 12.0 Solutes/$Nm^2$)

When the grain boundary number density of solute C and solute B is set to 1.0 solute/$nm^2$ or more, the occurrence of peeling during punching or shearing is suppressed. This is assumed to be because the solute C and the solute B strengthen grain boundaries. When the grain boundary number density of the solute C and the solute B exceeds 12.0 solutes/$nm^2$, the effect of suppressing the occurrence of peeling is saturated. Furthermore, coarse cementite is precipitated and the hole expansibility of the steel sheet degrades. Therefore, the total grain boundary number density of the solute C and the solute B is set to 1.0 to 12.0 solutes/$nm^2$. In order to further improve the peeling resistance, the total grain boundary number density of the solute C and the solute B is preferably set to 2.0 solutes/$nm^2$ or more. In addition, in order to more reliably suppress the precipitation of coarse cementite and the consequent degradation of the hole expansibility, the total grain boundary number density of the solute C and the solute B is preferably set to 10.0 solutes/$nm^2$ or less.

The grain boundary number density of the solute C and the solute B is measured using the three-dimensional atom probe method. A position sensitive atom probe (PoSAP), which was developed by A. Cerezo et al. from Oxford University in 1988, is a device that includes a position sensitive detector installed in a detector of the atom probe and is capable of measuring the flight time and position of an atom that has reached the detector at the same time without using an aperture upon analysis. The use of this device enables all constituent elements in an alloy present on the surface of a sample to be displayed as a two-dimensional map with an atom-level spatial resolution. In addition, it is also possible to expand the two-dimensional map in the depth direction and display and analyze the constituent elements as a three-dimensional map by evaporating atomic layers on the surface of the sample one by one using the electric field evaporation phenomenon.

For the observation of grain boundaries, a grain boundary portion is made to be the tip end portion of a needle with a scanning beam having an arbitrary shape at the time of forming the cut-out sample into a needle shape by electrolytic polishing using FB2000A manufactured by Hitachi, Ltd. as a focused ion beam (FIB) device. A needle-shaped sample for PoSAP including the grain boundary portion is produced in the above-described manner. In addition, grain boundaries are specified while observing the needle-shaped sample for PoSAP using contrast generated across crystal grains having different orientations by the channeling phenomenon of a scanning ion microscope (SIM) and are cut with ion beams. The device used as the three-dimensional atom probe is OTAP manufactured by CAMECA, and, as the measurement conditions, the temperature at the sample position is set to approximately 70 K, the total probe voltage is set to 10 kV to 15 kV, and the pulse ratio is set to 25%. In addition, grain boundaries and the insides of grains of each sample are measured three times, and the average value thereof is used as the representative value. The solute C and the solute B present in the grain boundaries and the insides of the grains are measured in the above-described manner.

A value obtained by removing background noise and the like from the measured value is defined as the atomic density per unit grain boundary area, and this is used as the grain boundary number density (solutes/$nm^2$). Therefore, the solute C present at the grain boundary is a C atom present at the grain boundary, and the solute B present at the grain boundary is a B atom present at the grain boundary. In the present embodiment, the total grain boundary number density of the solute C and the solute B is the total number of the solute C and the solute B present per unit grain boundary area. This value is a value obtained by adding the measurement values of the solute C and the solute B together.

The steel sheet according to the present embodiment prescribes the total of the pole densities of {211}<011> and {332}<113> at the thickness middle portion of the steel sheet. The thickness middle portion in the present embodiment refers to a range of approximately 1/10 of the sheet thickness in each of the front direction and the rear direction of the steel sheet from the thickness middle position (the ½ depth position of the sheet thickness from the surface of the steel sheet). For example, when the sheet thickness of the steel sheet is 2 mm, the thickness middle portion refers to a range of approximately 100 μm in each of the front direction and the rear direction across the thickness middle position as a boundary.

The reason for prescribing the texture in the thickness middle portion is that the texture in the thickness middle portion and mechanical properties favorably correlate with each other. The reason is not clear, but the present inventors assume as described below. In the steel sheet, due to friction between a roll and the steel sheet during rolling, shear deformation occurs in opposite directions in the front and rear of the steel sheet, and plane strain deformation occurs in the thickness middle portion. Since the texture of the steel sheet changes in the sheet thickness direction in response to this deformation, and the directions of the shear deformation are opposite to each other in the front and rear of the steel sheet, symmetric orientations develop in the front and rear in the texture. Therefore, the influences of the texture on mechanical properties are offset in the front and rear, and consequently, the texture in the thickness middle portion and the mechanical properties favorably correspond to each other.

(Total of Pole Densities of {211}<011> and {332}<113> in Thickness Middle Portion: 12.0 or Less)

Development of {211}<011> and {332}<113> significantly degrades the stretch flangeability of the steel sheet. In addition, the present inventors found that, when the total of the pole densities of {211}<011> and {332}<113> increase, the peeling of a punched end surface is likely to occur. The reason therefor is not clear, but is assumed to be related to the fact that, in a case where the pole densities thereof develop, the metallographic structure is often flat, and the propagation of cracks generated from inclusions, the interfaces of the metallographic structure, or the like is likely to be promoted. Therefore, the total of the pole densities of {211}<011> and {332}<113> is set to 12.0 or less. The total of the pole densities of {211}<011> and {332}<113> is more preferably 10.0 or less. The total of the pole densities is preferably as small as possible; however, since the pole density of each orientation group is 1.0 in a case where the steel sheet does not include any texture, the total of the pole densities is more preferably set to a value close to 2.0.

The pole density can be obtained from crystal orientation information by the EBSD analysis and is a synonym of the X-ray random intensity ratio.

It should be noted that {hkl} indicates a crystal plane parallel to a rolled surface and <uvw> indicates a crystal orientation parallel to a rolling direction. That is, {hkl}<uvw> indicates a crystal in which {hkl} is oriented in the sheet surface normal line direction and <uvw> is oriented in the rolling direction.

In addition, in the present embodiment, the pole density of each crystal orientation in the thickness middle portion is obtained by measuring of the crystal grain orientation information of 1,000 or more bcc's while differentiating fcc and bcc in the thickness middle portion (the range of approximately 1/10 of the sheet thickness in each of the front direction and the rear direction of the steel sheet from the thickness middle position (the ½ depth position of the sheet thickness from the surface of the steel sheet)) by EBSD analysis using a device manufactured by combining a scanning electron microscope and an EBSD analyzer and OIM Analysis (registered trademark) manufactured by AMETEK. Inc. and performing ODF analysis using the harmonic series expansion.

<Mechanical Properties>

(Tensile Strength: 780 MPa or More)

The steel sheet according to the present embodiment has a high strength and is excellent in terms of low temperature toughness, elongation, and stretch flangeability by the control of the metallographic structure and the texture. However, when the tensile strength of the steel sheet is small, an effect of vehicle body weight reduction, stiffness improvement, or the like is weak. Therefore, the tensile strength (TS) of the steel sheet according to the present embodiment is set to 780 MPa or more. Although the upper limit is not particularly prescribed, since press forming becomes more difficult as the strength increases, the tensile strength may be 1800 MPa or less, 1500 MPa or less, and 1300 MPa or less.

The elongation of the steel sheet is evaluated by the total elongation at fracture (El) prescribed in JIS Z 2241:2011 using a No. 5 test piece of JIS Z 2241:2011, and TS×El that serves as an index of the balance between strength and elongation is preferably 12000 MPa % or more and more preferably 13000 MPa % or more.

The stretch flangeability of the steel sheet is evaluated by the limiting hole expansion ratio (2) prescribed in JIS Z 2256:2010, and TS×λ that serves as an index of the balance between strength and stretch flangeability is preferably 50000 MPa·% or more and more preferably 55000 MPa % or more.

Regarding the low temperature toughness of the steel sheet, the fracture appearance transition temperature (vTrs) in the Charpy impact test prescribed in JIS Z 2242:2005 is preferably −40° C. or lower.

<Manufacturing Method>

The reason for limiting the conditions for manufacturing the steel sheet according to the present embodiment will be described.

The present inventors are confirming that the steel sheet according to the present embodiment is obtained by a manufacturing method including hot rolling and cooling as described below.

First, multi-pass hot rolling is performed on a slab having the above-described chemical composition using a plurality of rolling stands, thereby manufacturing a hot rolled steel sheet. The slab that is subjected to the hot rolling may be a slab obtained by continuous casting or casting and blooming or may be also a slab obtained by additionally performing hot working or cold working on the above-described slab. The multi-pass hot rolling can be performed using a reverse mill or a tandem mill, and, from the viewpoint of industrial productivity, a tandem mill is preferably used in at least several stages from the end.

(Heating Temperature in Hot Rolling: 1200° C. To 1350° C.)

When the temperature of the slab or a steel piece that is subjected to hot rolling is lower than 1200° C., the solutionizing of a Ti carbide becomes insufficient, the strength or workability of the steel sheet degrades, and furthermore, peeling is likely to occur. The temperature of the slab or steel piece that is subjected to hot rolling is preferably 1240° C. or higher and more preferably 1260° C. or higher. On the other hand, when the temperature of the slab or steel piece that is subjected to hot rolling is higher than 1350° C., there is a case where a thick scale is generated to decrease the yield or significant damage is imparted to a heating furnace at the time of heating the slab or steel piece in the heating furnace. Therefore, the temperature of the slab or steel piece that is subjected to hot rolling is set to 1350° C. or lower. The temperature of the slab or steel piece that is subjected to hot rolling is preferably 1300° C. or lower.

It should be noted that the temperature of the slab or steel piece that is subjected to hot rolling needs to be within the above-described temperature range, and a steel ingot or steel piece having a temperature of lower than 1200° C. may be subjected to hot rolling after being charged into a heating furnace and heated up to the above-described temperature range or a slab obtained by continuous casting or a steel piece obtained by blooming may be subjected to hot rolling without performing a heat treatment thereon while holding a high-temperature state of 1200° C. or higher.

(Total Rolling Reduction within Temperature Range of from Higher than FT+50° C. To FT+150° C.: 50% or More)

In the present embodiment, the finish temperature is represented by FT in a unit of ° C., and the total rolling reduction of hot rolling within a temperature range of from higher than FT+50° C. to FT+150° C. is increased, thereby refining recrystallized austenite grains in the steel sheet. In order to refine recrystallized austenite grains in the steel sheet, the total rolling reduction within the temperature range of higher than FT+50° C. to FT+150° C. is set to 50% or more. When the total rolling reduction within the above-described temperature range is less than 50%, since austenite is not sufficiently refined, metallographic structures after transformation become coarse, and recrystallization between rolling passes during rolling within a subsequent temperature range of from FT to FT+50° C. is delayed, the texture after transformation develops. The total rolling reduction within the temperature range of from higher than FT+50° C. to FT+150° C. is preferably as high as possible, but may be set to 90% or less since approximately 90% is an industrial limit.

(Total Rolling Reduction within Temperature Range of from FT to FT+50° C.: 40% to 80%)

(Time Necessary for Rolling at FT to FT+50° C.: 0.5 to 10.0 Seconds)

In the present embodiment, a steel sheet being excellent in terms of workability and toughness can be obtained by appropriately controlling the total rolling reduction within a temperature range of from FT to FT+50° C. and the time necessary for rolling in association with the cooling conditions after hot rolling described below.

When the total rolling reduction within the temperature range of from FT to FT+50° C. is less than 40%, the structure after transformation becomes coarse, recrystallization between rolling passes and after rolling finish is delayed, the amount of deformation of the inside of the steel sheet becomes uneven, and a specific orientation develops after transformation, and thus the stretch flangeability of the steel sheet degrades. Therefore, the total rolling reduction within the temperature range of from FT to FT+50° C. is set to 40% or more. On the other hand, when the total rolling reduction within the above-described temperature range exceeds 80%, since the texture significantly develops even after recrystallization, the stretch flangeability of the steel sheet degrades. Therefore, the total rolling reduction within the temperature range of from FT to FT+50° C. is set to 80% or less.

In the present embodiment, furthermore, it is also important to appropriately control the time necessary for rolling within the above-described temperature range. In a case where the time necessary for rolling within the above-described temperature range is too short, recrystallization does not proceed between passes, rolling strain is excessively stored, and a specific orientation develops, which makes it difficult to obtain a desired texture. Therefore, the time necessary for rolling within the above-described temperature range is set to 0.5 seconds or longer. The time is preferably 1.0 second or longer and more preferably 2.0 seconds or longer. On the other hand, in a case where the time necessary for rolling within the above-described temperature range is too long, recrystallized grains grow between rolling passes, and the structure after transformation becomes coarse. Therefore, the time necessary for rolling within the above-described range is set to 10.0 seconds or shorter. The time is preferably 8.0 seconds or shorter, more preferably 6.0 seconds or shorter, and still more preferably 5.0 seconds or shorter.

Since it is important to repeat working and recrystallization in both the rolling within the temperature range of from higher than FT+50° C. to FT+150° C. and the rolling within the temperature range of from FT to FT+50° C., two or more passes of rolling are performed within each of the temperature ranges. From the viewpoint of suppressing the development of the texture of the steel sheet, the maximum rolling reduction per pass within the temperature range of from higher than FT+50° C. to FT+150° C. is preferably 60% or less and more preferably 55% or less. The maximum rolling reduction per pass within the temperature range of from FT to FT+50° C. is preferably 50% or less, more preferably 45% or less, still more preferably 40% or less, and most preferably 35% or less.

It should be noted that the total rolling reduction refers to the percentage of the total rolling reduction within a predetermined temperature range with respect to the inlet sheet thickness before the initial pass in this temperature range (the difference between the inlet sheet thickness before the initial pass of rolling within this predetermined temperature range and the outlet sheet thickness after the final pass of rolling within this temperature range).

(Average Cooling Rate within Temperature Range of from FT to FT+100° C.: 6.0° C./Sec or Faster)

The temperature of the steel sheet during hot rolling changes due to deformation heating by rolling, removal of heat by contact with a roll, or the like; however, in the present embodiment, a steel sheet having excellent peeling resistance can be obtained by appropriately controlling the average cooling rate within a temperature range of from FT to FT+100° C. When the steel sheet dwells within a low temperature range of finish rolling for a long period of time, the working-induced precipitation of a carbide or a nitride occurs to decrease the strength, and the grain boundary number density of the solute C and the solute B decreases to make it difficult to suppress peeling. Therefore, the average cooling rate within the temperature range of from FT to FT+100° C. is set to 6.0° C./sec or faster. The average cooling rate is preferably 9.0° C./sec or faster, more preferably 12.0° C./sec or faster, and still more preferably 15.0° C./sec or faster. The upper limit does not need to be particularly limited, but an abrupt temperature change significantly fluctuates deformation resistance to degrade the passability, and thus the upper limit is preferably 50° C./sec or slower, more preferably 40° C./sec or slower, still more preferably 30° C./sec or slower, and far still more preferably 20° C./sec or slower.

It should be noted that the average cooling rate within the above-described temperature range is controlled by controlling deformation heating by controlling the rolling rate and the rolling reduction and the removal of heat due to the contact between the steel sheet and a roll. Furthermore, the average cooling rate is controlled by performing water cooling, induction heating, or the like as necessary. In addition, the average cooling rate within the above-described temperature range is obtained by measuring the surface temperature of the steel sheet with a radiation-type thermometer or the like or by simulation in a case where the measurement is difficult.

(Finish Temperature FT: Equal to or Higher than $Ar_3$ Obtained from Expression (1), Equal to or Higher than TR Obtained from Expression (2), and 1100° C. Or Lower)

$$Ar_3\ (C)=901-325\times[C]+33\times[Si]-92\times[Mn]+287\times[P]+40\times[sol.\ Al] \quad (1)$$

$$TR\ (°\ C.)=800+700\times[Ti]+1000\times[Nb] \quad (2)$$

Here, [element symbol] in Expressions (1) and (2) indicates the amount of each element by mass %, and zero is assigned in a case where the element is not contained.

In the present embodiment, the working and recrystallization of austenite during finish rolling are repeated, thereby refining the metallographic structures and suppressing the development of the texture. Therefore, the finish temperature FT is set to equal to or higher than $Ar_3$ that is obtained from Expression (1) and equal to or higher than TR that is obtained from Expression (2). Here, the finish temperature FT refers to the surface temperature of the steel sheet immediately after final rolling.

When FT is lower than $Ar_3$, ferritic transformation proceeds during finish rolling, and worked ferrite is formed, which degrades the elongation or stretch flangeability of the steel sheet. In addition, when FT is lower than TR, austenite becomes significantly flat after hot rolling and before cooling, the structure is stretched in a rolling direction in the steel sheet as a final product, and the plastic anisotropy increases, which degrades the elongation and stretch flangeability of the steel sheet. When FT is set to equal to or higher than TR, the recrystallization of worked austenite between rolling passes is appropriately accelerated, whereby it is possible to refine recrystallized austenite grains. After hot rolling, it is possible to obtain a steel sheet having steel structures and a texture preferable for low temperature toughness and stretch flangeability in association with the cooling conditions after hot rolling described below. FT is preferably TR+20° C. or higher and more preferably TR+40° C. or higher. Furthermore, the finish temperature FT is preferably higher than 900° C.

On the other hand, when FT exceeds 1100° C., the structure becomes coarse, and the low temperature toughness of the steel sheet degrades. Therefore, FT is set to 1100° C. or lower. FT is preferably 1080° C. or lower and more preferably 1060° C. or lower.

It should be noted that the temperature during finish rolling refers to the surface temperature of steel and can be measured using a radiation-type thermometer or the like.

(Time from Completion of Finish Rolling to Initiation of Water Cooling: Within 3.0 Seconds)

After the completion of finish rolling, water cooling is initiated within 3.0 seconds in order to refine the metallographic structure using strain stored by rolling. This water cooling may be performed in a plurality of divided stages. When the time from the completion of finish rolling to the initiation of water cooling is longer than 3.0 seconds, strain in austenite is recovered, which makes it difficult to obtain a desired structure. The time from the completion of finish rolling to the initiation of water cooling is preferably within 2.0 seconds, more preferably within 1.0 second, and still more preferably within 0.5 seconds. The time from the completion of finish rolling to the initiation of water cooling is preferably 0.05 seconds or longer in order to recrystallize austenite after the completion of finish rolling.

(Average Cooling Rate within Temperature Range of from FT to 750° C.: 30° C./Sec or Faster)

The control of the average cooling rate at the time of cooling the steel sheet from a temperature at which finish rolling is completed (finish temperature: FT (° C.)) to 750° C. is important to obtain a desired metallographic structure. It should be noted that, in the calculation of the average cooling rate, the time from the completion of finish rolling to the initiation of water cooling is included as the time. When the average cooling rate within the above-described temperature range is slower than 30° C./sec, the formation of a fine structure becomes difficult, and ferrite or pearlite is precipitated in the cooling process, which degrades the stretch flangeability or low temperature toughness of the steel sheet. In addition, the grain boundary number density of the solute C and the solute B decreases, which makes it difficult to suppress peeling. Therefore, the average cooling rate within the above-described temperature range is set to 30° C./sec or faster. The average cooling rate is preferably 40° C./sec or faster and more preferably 50° C./sec or faster. The upper limit does not need to be particularly limited, but is preferably 300° C./sec or slower, more preferably 200° C./sec or slower, still more preferably 150° C./sec or slower, and far still more preferably 110° C./sec or slower from the viewpoint of suppressing sheet warpage attributed to thermal strain.

Within a temperature range of from FT to 750° C., fast cooling within a high temperature range after the end of finish rolling enables the metallographic structure to be further refined and further improves the low temperature toughness of the steel sheet. In order for that, it is preferable to initiate water cooling within 0.3 seconds after the completion of finish rolling, set the average cooling rate at FT to 750° C. to 30° C./sec or faster, and, additionally, set the average cooling rate at FT to FT−40° C. to 100° C./sec or faster. In this case, the fast cooling does not hinder the water cooling to be performed in a step intended for rapid cooling within the temperature range of from FT to FT-40° C. and in a plurality of cooling steps for performing subsequent cooling. When the average cooling rate at FT to FT−40° C. is slower than 100° C./sec, it becomes difficult to obtain the above-described effect. The average cooling rate at FT to FT−40° C. is preferably 120° C./sec or faster and more preferably 150° C./sec or faster. The upper limit does not need to be particularly limited, but is preferably 1000° C./sec or slower from the viewpoint of suppressing a temperature unevenness in the steel sheet.

The rapid cooling within the high temperature range after the end of the finish rolling (cooling at FT to FT-40° C.) is not limited to be performed after the final stand of finish rolling and may be performed between rolling stands. That is, the rapid rolling may not be performed in a stand after the fast cooling is performed or rolling with a rolling reduction of 8% or less may be added for the purpose of shape correction, cooling control, or the like. In this case, rolling after the rapid cooling is not included in a finish rolling step.

(Dwell Time at 750° C. To 600° C.: 20 Seconds or Shorter)

When the hot rolled steel sheet after finish rolling reaches a temperature range of from 750° C. to 600° C., transformation of austenite into ferrite becomes active. Therefore, it is possible to obtain a desired area fraction of ferrite by adjusting the dwell time within the above-described temperature range. In order to precipitate a larger amount of ferrite for the purpose of improving ductility, the hot rolled steel sheet is preferable made to dwell within the above-described temperature range for 5 seconds or longer. When the dwell time within the above-described temperature range exceeds 20 seconds, ferrite is excessively precipitated, pearlite or cementite is precipitated, or the grain boundary number density of the solute C and the solute B decreases, which creates a concern of the occurrence of peeling. Therefore, the dwell time within the above-described temperature range is preferably set to 20 seconds or shorter. The dwell time is preferably 17 seconds or shorter and more preferably 14 seconds or shorter.

It should be noted that, in the present embodiment, the dwell time at 750° C. to 600° C. refers to a time taken for the temperature of the steel sheet after finish rolling to reach 750° C. and then decrease to reach 600° C., and the steel sheet does not necessarily need to be cooled within this time range at all times.

(Average Cooling Rate within Temperature Range of from 600° C. To "Cooling Stop Temperature of Lower than Ms−200° C.": 30° C./Sec or Faster)

In order to transform untransformed austenite to fresh martensite or bainite and to suppress the precipitation of cementite, the average cooling rate within a temperature range of from 600° C. to a cooling stop temperature is set to 30° C./sec or faster, and the cooling stop temperature is set to lower than Ms−200° C. That is, the average cooling rate within the temperature range from 600° C. to the cooling stop temperature of lower than Ms−200° C. is set to 30° C./sec or faster. When the average cooling rate within the above-described temperature range is slower than 30° C./sec, it becomes difficult to obtain a desired metallographic structure due to the formation of cementite or pearlite during cooling or the like. The average cooling rate within the above-described temperature range is preferably 40° C./sec or faster and more preferably 50° C./sec or faster. The upper limit of the average cooling rate within the above-described temperature range is not particularly limited, but is preferably 300° C./sec or slower, more preferably 200° C./sec or slower, still more preferably 150° C./sec or slower, and far still more preferably 110° C./sec or slower from the viewpoint of suppressing sheet warpage attributed to thermal strain.

In addition, in order to further transform untransformed austenite to fresh martensite or bainite and to further suppress the precipitation of cementite, the cooling stop temperature is preferably Ms−250° C. and more preferably Ms−300° C. Furthermore, the cooling stop temperature is preferably lower than 100° C.

(Average Cooling Rate within Temperature Range of from Ms to "Cooling Stop Temperature of Lower than Ms−200° C.": 80° C./Sec or Faster)

In order to further increase the tensile strength of the steel sheet, suppress the precipitation of cementite, and suppress a decrease in the grain boundary number density of the solute C and the solute B, an average cooling rate within a temperature range of from Ms to the cooling stop temperature of lower than Ms−200° C. is preferably set to 80° C./sec or faster. The average cooling rate is more preferably 100° C./sec or faster and still more preferably 120° C./sec or faster. The upper limit does not need to be particularly limited, but is preferably 500° C./sec or slower, more preferably 400° C./sec or slower, still more preferably 300° C./sec or slower, and far still more preferably 200° C./sec or slower from the viewpoint of the uniformity of the structure in the sheet thickness direction.

(Heat Treatment Step)

(Maximum Attainment Temperature Tmax: 300° C. To 720° C.)

A steel sheet having an excellent balance among strength, ductility, and toughness can be obtained by tempering fresh martensite and bainite formed in the hot rolling step by a heat treatment and precipitating carbides of Ti or Nb. When the maximum attainment temperature is lower than 300° C., the atomic weight of C or the like is small, and only an element capable of easily diffusing diffuses to form MA and coarse cementite, which deteriorates the toughness and hole expansibility of the steel sheet. Therefore, the maximum attainment temperature Tmax is set to 300° C. or higher. Meanwhile, when the heat treatment is excessively performed, it becomes difficult to obtain a desired strength, and the stretch flangeability or toughness of the steel sheet deteriorates due to the formation of pearlite or coarse cementite and the excess precipitation of a Ti carbide. In addition, the grain boundary number density of the solute C and the solute B decreases, which makes it difficult to suppress peeling. Therefore, the maximum attainment temperature Tmax is set to 720° C. or lower.

(Tempering Parameter Ps: $14.6\times Tmax+5891 \leq Ps \leq 17.1\times Tmax+6223$)

In the heat treatment step, tempering of fresh martensite and bainite and the precipitation of a carbide such as TiC occurs competitively, whereby a steel sheet being excellent in terms of strength, workability, toughness, and peeling resistance can be obtained. Specifically, when fresh martensite and bainite are softened by tempering, whereby the elongation and the toughness improve, and the hardness difference from ferrite decreases to improve stretch flangeability. Furthermore, as the heat treatment temperature rises, the strength of fresh martensite and bainite further decreases, but the precipitation of a carbide such as TiC is promoted at the same time. Therefore, the decrease in the strength attributed to the tempering of fresh martensite and bainite is supplemented by precipitation hardening, whereby a steel sheet being excellent in terms of strength, workability, toughness, and peeling resistance can be obtained. In a case where the heat treatment is insufficient, the effect of improving ductility, stretch flangeability, toughness, and peeling resistance cannot be obtained. Therefore, Ps is set to $14.6\times Tmax+5891$ or more. In a case where the heat treatment is excessively performed, the strength decreases, coarse cementite is precipitated, or TiC is excessively precipitated, and thus the stretch flangeability, toughness, and peeling resistance of the steel sheet deteriorate. Therefore, Ps is set to $17.1\times Tmax+6223$ or less.

In a case where the heat treatment temperature is constant, the tempering parameter Ps can be obtained from $Ps=(T+273)\times(20+\log(t))$. In the expression, T represents the heat treatment temperature (° C.) and t represents the heat treatment time (h). However, in a case where the heat treatment temperature is not constant, that is, in a case where the temperature changes continuously as in continuous annealing, it is possible to calculate the tempering parameter as an integrated tempering parameter by a method considering a heat treatment step as described in Non-Patent Document 1. In the present embodiment, the integrated tempering parameter calculated based on the method described in Non-Patent Document 1 is used as the tempering parameter Ps.

The tempering parameter Ps is specifically obtained by the following method.

The time from the initiation of heating to the end of heating is divided into a total number N of infinitely small changes in time Δt. Here, the average temperature in a $(n-1)^{th}$ section is represented by Tn−1 (° C.), and the average temperature in the $n^{th}$ section is represented by Tn (° C.). The tempering parameter P (1) corresponding to the initial infinitely small change in time (the section in the case of n=1) can be obtained from the following expression. It should be noted that "log" indicates a common logarithm with base 10.

$$P(1)=(T1+273)\times(20+\log(\Delta t))$$

P (1) can be expressed as a value equivalent to P that is calculated based on the temperature T2 and the heating time t2 from the following expression.

$$(T1+273)\times(20+\log(\Delta t))=(T2+273)\times(20+\log(t2))$$

The time t2 is a time taken (equivalent time) to obtain P equivalent to the integrated value of P that is calculated based on heating in the section before the second section (that is, the first section) at the temperature T2. The heating time in the second section (temperature T2) is a time obtained by adding the actual heating time Δt to the time t2. Therefore, the integrated value P (2) of P at a point in time when the heating in the second section is completed can be obtained from the following expression.

$$P(2)=(T2+273)\times(20+\log(t2+\Delta t))$$

This expression is generalized to Expression (4).

$$P(n)=(Tn+273)\times(20+\log(tn+\Delta t)) \quad (4)$$

The time tn is an equivalent time for obtaining P equivalent to the integrated value of P at a point in time when the heating in the $(n-1)^{th}$ section is completed at the temperature Tn. The time tn can be calculated from Expression (5).

$$\log(tn)=((Tn-1+273)/(Tn+273))\times(20+\log(tn-1))-20 \quad (5)$$

The $N^{th}$ tempering parameter P (n) obtained by the above-described method is the integrated value of P at a point in time when heating in the $N^{th}$ section is completed, and this is Ps.

In the present embodiment, the steel sheet may be made into a plated steel sheet by performing plating in the heat treatment step. In the case of performing plating after the heat treatment, the plating step may be regarded as a continuous step of the heat treatment step and may be performed within the scope of the above-described heat treatment conditions, which does not create any problems. The plating may be either electro plating or hot-dip plating. The plating type is also not particularly limited and is ordinarily zinc-based plating including zinc plating and zinc alloy plating. As examples of the plated steel sheet, an electrolytic zinc-plated steel sheet, an electrolytic zinc-nickel alloy-coated steel sheet, a hot-dip galvanized steel sheet, a galvannealed steel sheet, a hot-dip zinc-aluminum alloy-coated steel sheet, and the like are exemplary examples. The plating adhesion amount may be an ordinary amount. Before plating, Ni or the like may be coated to the surface as pre-plating.

At the time of manufacturing the steel sheet according to the present embodiment, well-known temper rolling for the purpose of shape correction may be appropriately performed.

The sheet thickness of the steel sheet according to the present embodiment is not particularly limited, but is preferably 6.0 mm or less since, in a case where the sheet thickness is too thick, structures formed in the surface layer and the inside of the steel sheet significantly differ. On the other hand, when the sheet thickness is too thin, since threading during hot rolling becomes difficult, the sheet thickness is, ordinarily, preferably 1.0 mm or more. The sheet thickness is more preferably 1.2 mm or more.

EXAMPLES

Next, the effect of one aspect of the present invention will be more specifically described using examples, but conditions in the examples are simply examples of the conditions adopted to confirm the feasibility and effect of the present invention, and the present invention is not limited to these examples of the conditions. The present invention is capable of adopting a variety of conditions as long as the object of the present invention is achieved without departing from the gist of the present invention.

Steels having a chemical composition shown in Table 1 were melted, cast and then made into steel pieces having a thickness of 30 to 40 mm by hot forging. The obtained steel pieces were heated, hot rolled by performing rolling a plurality of times (two to four passes) in a small tandem mill for testing within both of a temperature range of higher than FT+50° C. and FT+150° C. or lower and a temperature range of from FT to FT+50° C. to obtain sheet thicknesses of 2.5 to 3.5 mm, and subjected to a heat treatment, thereby obtaining steel sheets. The manufacturing conditions are shown in Table 2A and Table 2B. It should be noted that the time interval at the time of calculating the tempering parameter Ps was set to 1 second. In addition, plating was performed on a part of the steel sheets.

TABLE 1

| | Chemical composition (mass %) Remainder: Fe and impurity | | | | | | | | | $Ar_3$ | Ms | TR | |
|---|---|---|---|---|---|---|---|---|---|---|---|---|---|
| Steel | C | Si | Mn | Ti | sol. Al | N | P | S | Others | (° C.) | (° C.) | (° C.) | Note |
| A | 0.07 | 1.050 | 1.89 | 0.109 | 0.310 | 0.0035 | 0.010 | 0.0030 | | 754 | 465 | 876 | Invention Steel |
| B | 0.09 | 1.180 | 3.58 | 0.100 | 0.200 | 0.0032 | 0.015 | 0.0025 | | 594 | 400 | 870 | Comparative Steel |
| C | 0.07 | 1.100 | 1.85 | 0.095 | 0.300 | 0.0031 | 0.016 | 0.0025 | B: 0.0012 | 761 | 467 | 867 | Invention Steel |
| D | 0.26 | 0.980 | 2.10 | 0.060 | 0.340 | 0.0028 | 0.012 | 0.0030 | | 673 | 368 | 842 | Comparative Steel |
| E | 0.06 | 0.950 | 1.75 | 0.107 | 0.380 | 0.0022 | 0.010 | 0.0018 | Nb: 0.008 | 770 | 475 | 875 | Invention Steel |
| F | 0.06 | 1.050 | 1.72 | 0.117 | 0.290 | 0.0029 | 0.014 | 0.0030 | Mo: 0.150, Cr: 0.36 | 774 | 473 | 882 | Invention Steel |
| G | 0.06 | 1.050 | 1.70 | 0.134 | 0.410 | 0.0022 | 0.017 | 0.0031 | | 781 | 476 | 894 | Invention Steel |
| H | 0.07 | 0.990 | 1.77 | 0.234 | 0.380 | 0.0024 | 0.014 | 0.0039 | | 767 | 469 | 964 | Comparative Steel |
| I | 0.06 | 1.010 | 1.85 | 0.119 | 0.410 | 0.0028 | 0.016 | 0.0033 | Nb: 0.048 | 766 | 472 | 931 | Invention Steel |
| J | 0.07 | 1.080 | 1.63 | 0.130 | 0.280 | 0.0036 | 0.013 | 0.0039 | Ca: 0.0018 | 779 | 474 | 891 | Invention Steel |
| K | 0.06 | 1.060 | 1.73 | 0.129 | 0.390 | 0.0034 | 0.017 | 0.0031 | Bi: 0.0012 | 778 | 475 | 890 | Invention Steel |
| L | 0.07 | 1.180 | 1.78 | 0.120 | 0.040 | 0.0036 | 0.019 | 0.0040 | | 760 | 469 | 884 | Invention Steel |
| M | 0.06 | 1.100 | 1.73 | 0.123 | 0.320 | 0.0030 | 0.019 | 0.0044 | V: 0.090 | 777 | 475 | 886 | Invention Steel |
| N | 0.15 | 1.150 | 1.60 | 0.099 | 0.320 | 0.0025 | 0.012 | 0.0035 | | 759 | 437 | 869 | Invention Steel |
| O | 0.11 | 0.550 | 2.20 | 0.120 | 0.510 | 0.0041 | 0.012 | 0.0032 | | 705 | 436 | 884 | Invention Steel |
| P | 0.07 | 1.100 | 0.85 | 0.100 | 0.410 | 0.0035 | 0.010 | 0.0022 | | 856 | 500 | 870 | Comparative Steel |
| Q | 0.07 | 1.070 | 1.71 | 0.128 | 0.400 | 0.0040 | 0.019 | 0.0049 | Mg: 0.0012 | 778 | 471 | 890 | Invention Steel |
| R | 0.07 | 1.040 | 1.84 | 0.119 | 0.370 | 0.0032 | 0.021 | 0.0031 | | 764 | 467 | 883 | Invention Steel |
| S | 0.07 | 1.080 | 2.06 | 0.135 | 0.400 | 0.0032 | 0.017 | 0.0036 | REM: 0.0016 | 745 | 460 | 895 | Invention Steel |
| T | 0.07 | 1.340 | 1.74 | 0.110 | 0.070 | 0.0029 | 0.012 | 0.0025 | | 769 | 470 | 877 | Invention Steel |
| U | 0.05 | 0.980 | 1.66 | 0.134 | 0.360 | 0.0037 | 0.019 | 0.0038 | Cu: 0.15, Ni: 0.30 | 784 | 477 | 894 | Invention Steel |
| V | 0.04 | 0.010 | 1.52 | 0.112 | 0.350 | 0.0025 | 0.015 | 0.0021 | Nb: 0.021 | 767 | 492 | 899 | Invention Steel |

Underlines indicate that values are outside the scope of the present invention.

TABLE 2A

| Steel sheet No. | Steel | Heating temperature (° C.) | Total rolling reduction in temperature range of higher than FT + 50° C. to FT + 150° C. or lower (%) | Total rolling reduction in temperature range of FT ° C. to FT + 50° C. (%) | Rolling time in temperature range of FT ° C. to FT + 50° C. (s) | Average cooling rate in temperature range of FT to FT + 100° C. (° C./sec) | Finish temperature (° C.) | Time after finish rolling to initiation of water cooling (s) |
|---|---|---|---|---|---|---|---|---|
| 1 | A | 1267 | 60 | 79 | 3.2 | 15.1 | 917 | 0.2 |
| 2 | A | 1271 | 62 | 44 | 2.2 | 17.8 | 939 | 0.6 |
| 3 | A | 1265 | 58 | 48 | 2.3 | 16.4 | 951 | 0.4 |
| 4 | A | 1263 | 63 | 70 | 2.2 | 15.7 | 989 | 2.0 |
| 5 | A | 1266 | 61 | 73 | 2.0 | 15.8 | 946 | 0.3 |
| 6 | A | 1267 | 61 | 71 | 2.1 | 16.2 | 958 | 0.1 |
| 7 | A | 1267 | 65 | 65 | 3.6 | 15.1 | 951 | 0.1 |
| 8 | A | 1266 | 24 | 65 | 1.9 | 17.2 | 926 | 0.5 |
| 9 | A | 1272 | 78 | 85 | 3.2 | 15.1 | 903 | 0.4 |
| 10 | A | 1266 | 63 | 72 | 0.4 | 16.5 | 902 | 0.5 |
| 11 | A | 1266 | 65 | 67 | 3.5 | 2.4 | 921 | 1.0 |
| 12 | B | 1260 | 81 | 66 | 1.9 | 16.9 | 947 | 0.6 |
| 13 | C | 1262 | 82 | 66 | 2.2 | 15.0 | 953 | 0.5 |
| 14 | D | 1272 | 67 | 64 | 2.2 | 17.0 | 941 | 0.5 |
| 15 | E | 1260 | 69 | 66 | 2.2 | 15.1 | 966 | 0.1 |
| 16 | E | 1267 | 66 | 67 | 2.2 | 15.7 | 934 | 0.1 |
| 17 | F | 1273 | 65 | 66 | 2.1 | 16.8 | 940 | 0.1 |
| 18 | G | 1263 | 78 | 66 | 1.9 | 17.1 | 960 | 0.1 |
| 19 | H | 1264 | 67 | 66 | 1.5 | 16.8 | 940 | 0.1 |
| 20 | I | 1274 | 69 | 66 | 1.8 | 17.8 | 952 | 0.1 |
| 21 | J | 1271 | 66 | 65 | 1.7 | 16.7 | 956 | 0.1 |

| Steel sheet No. | Average cooling rate in temperature range of FT to FT − 40° C. (° C./sec) | Average cooling rate in temperature range of FT to 750° C. (° C./sec) | Dwell time between 600° C. to 750° C. (s) | Average cooling rate from 600° C. to cooling stop (° C./sec) | Average cooling rate from Ms to cooling stop (° C./sec) | Cooling stop temperature (° C.) | Maximum attainment temperature Tmax (° C.) | Tempering parameter Ps | 14.6 × Tmax + 5891 | 17.1 × Tmax + 6223 |
|---|---|---|---|---|---|---|---|---|---|---|
| 1 | 85 | 56 | 6 | 62 | 129 | 51 | 545 | 14073 | 13848 | 15543 |
| 2 | 85 | 56 | 7 | 61 | 129 | 52 | 553 | 14215 | 13965 | 15679 |
| 3 | 69 | 32 | 8 | 66 | 85 | 41 | 560 | 14404 | 14067 | 15799 |
| 4 | 12 | 42 | 11 | 67 | 125 | 24 | 554 | 14295 | 13979 | 15696 |
| 5 | 106 | 96 | 6 | 62 | 75 | 45 | 554 | 14249 | 13979 | 15696 |
| 6 | 178 | 83 | 6 | 70 | 131 | 49 | 652 | 15926 | 15410 | 17372 |
| 7 | 143 | 70 | 8 | 66 | 130 | 41 | 495 | 13193 | 13118 | 14688 |
| 8 | 61 | 52 | 5 | 75 | 124 | 40 | 542 | 14043 | 13804 | 15491 |
| 9 | 69 | 41 | 2 | 69 | 123 | 42 | 556 | 14265 | 14009 | 15731 |
| 10 | 59 | 48 | 6 | 61 | 135 | 38 | 554 | 14209 | 13979 | 15696 |
| 11 | 37 | 40 | 8 | 62 | 130 | 40 | 556 | 14257 | 14009 | 15731 |
| 12 | 65 | 55 | 5 | 60 | 105 | 45 | 505 | 14056 | 13264 | 14859 |
| 13 | 77 | 53 | 7 | 74 | 108 | 53 | 625 | 15422 | 15016 | 16911 |
| 14 | 75 | 32 | 6 | 64 | 115 | 65 | 550 | 15452 | 13921 | 15628 |
| 15 | 195 | 57 | 7 | 70 | 131 | 51 | 652 | 15896 | 15410 | 17372 |
| 16 | 201 | 18 | 6 | 69 | 125 | 36 | 645 | 15840 | 15308 | 17253 |
| 17 | 189 | 51 | 14 | 66 | 118 | 27 | 652 | 15891 | 15410 | 17372 |
| 18 | 178 | 61 | 15 | 66 | 128 | 21 | 600 | 15003 | 14651 | 16483 |
| 19 | 187 | 48 | 7 | 78 | 124 | 39 | 600 | 15984 | 14651 | 16483 |
| 20 | 179 | 47 | 7 | 75 | 115 | 60 | 625 | 15495 | 15016 | 16911 |
| 21 | 195 | 61 | 2 | 60 | 122 | 31 | 648 | 15896 | 15352 | 17304 |

Underlines indicate that values are outside the scope of the present invention.

TABLE 2B

| Steel sheet No. | Steel | Heating temperature (° C.) | Total rolling reduction in temperature range of higher than FT + 50° C. to FT + 150° C. or lower (%) | Total rolling reduction in temperature range of FT ° C. to FT + 50° C. (%) | Rolling time in temperature range of FT ° C. to FT + 50° C. (s) | Average cooling rate in temperature range of FT to FT + 100° C. (° C./sec) | Finish temperature (° C.) | Time after finish rolling to initiation of water cooling (s) |
|---|---|---|---|---|---|---|---|---|
| 22 | J | 1268 | 76 | 56 | 3.2 | 16.9 | 940 | 0.1 |
| 23 | K | 1280 | 69 | 67 | 1.9 | 17.7 | 932 | 0.1 |
| 24 | L | 1267 | 79 | 66 | 2.1 | 15.1 | 945 | 0.5 |
| 25 | L | 1280 | 66 | 72 | 3.9 | 17.6 | 950 | 0.5 |
| 26 | L | 1275 | 70 | 73 | 3.4 | 15.4 | 948 | 0.6 |
| 27 | M | 1261 | 81 | 66 | 1.9 | 18.0 | 948 | 0.1 |

TABLE 2B-continued

| | | | | | | | | |
|---|---|---|---|---|---|---|---|---|
| 28 | N | 1271 | 67 | 66 | 2.1 | 16.7 | 935 | 0.4 |
| 29 | N | 1262 | 82 | 65 | 1.7 | 16.3 | 840 | 0.4 |
| 30 | O | 1264 | 66 | 68 | 3.1 | 17.4 | 951 | 0.5 |
| 31 | P | 1265 | 68 | 62 | 2.4 | 17.3 | 946 | 0.6 |
| 32 | Q | 1276 | 78 | 67 | 2.1 | 17.3 | 948 | 0.1 |
| 33 | R | 1275 | 69 | 69 | 3.3 | 17.4 | 962 | 0.1 |
| 34 | S | 1265 | 68 | 70 | 2.0 | 15.5 | 929 | 0.1 |
| 35 | T | 1260 | 71 | 67 | 2.0 | 15.1 | 929 | 0.1 |
| 36 | T | 1270 | 62 | 69 | 2.7 | 15.0 | 965 | 0.1 |
| 37 | T | 1270 | 66 | 69 | 3.5 | 15.9 | 952 | 0.1 |
| 38 | U | 1263 | 69 | 68 | 3.1 | 15.4 | 933 | 0.1 |
| 39 | V | 1270 | 65 | 64 | 3.6 | 15.5 | 902 | 0.1 |
| 40 | A | 1285 | 85 | 75 | 4.7 | 12.5 | 945 | 0.1 |
| 41 | A | 1280 | 75 | 67 | 3.6 | 15.6 | 1050 | 0.1 |
| 42 | A | 1275 | 68 | 70 | 2.5 | 18.6 | 945 | 0.1 |
| 43 | A | 1278 | 66 | 69 | 3.9 | 15.4 | 956 | 0.1 |

| Steel sheet No. | Average cooling rate in temperature range of FT to FT − 40° C. (° C./sec) | Average cooling rate in temperature range of FT to 750° C. (° C./sec) | Dwell time between 600° C. to 750° C. (s) | Average cooling rate from 600° C. to cooling stop (° C./sec) | Average cooling rate from Ms to cooling stop (° C./sec) | Cooling stop temperature (° C.) | Maximum attainment temperature Tmax (° C.) | Tempering parameter Ps | 14.6 × Tmax + 5891 | 17.1 × Tmax + 6223 |
|---|---|---|---|---|---|---|---|---|---|---|
| 22 | 144 | 79 | 2 | 40 | 80 | 39 | 503 | 13773 | 13235 | 14824 |
| 23 | 165 | 45 | 7 | 71 | 156 | 64 | 605 | 15168 | 14724 | 16569 |
| 24 | 66 | 54 | 6 | 93 | 122 | 39 | 605 | 15088 | 14724 | 16569 |
| 25 | 55 | 49 | 8 | 66 | 130 | 40 | 280 | 10984 | 10709 | 11866 |
| 26 | 52 | 55 | 7 | 62 | 130 | 39 | 752 | 17716 | 16870 | 19082 |
| 27 | 187 | 50 | 7 | 76 | 119 | 55 | 514 | 14054 | 13395 | 15012 |
| 28 | 85 | 74 | 2 | 77 | 145 | 18 | 554 | 14285 | 13979 | 15696 |
| 29 | 54 | 38 | 3 | 85 | 105 | 44 | 543 | 14056 | 13819 | 15508 |
| 30 | 73 | 50 | 7 | 76 | 102 | 69 | 565 | 14387 | 14140 | 15885 |
| 31 | 77 | 49 | 7 | 81 | 111 | 73 | 564 | 14413 | 14125 | 15867 |
| 32 | 179 | 52 | 7 | 72 | 111 | 58 | 600 | 15005 | 14651 | 16483 |
| 33 | 156 | 48 | 7 | 92 | 135 | 63 | 600 | 15034 | 14651 | 16483 |
| 34 | 174 | 46 | 7 | 84 | 184 | 64 | 620 | 15409 | 14943 | 16825 |
| 35 | 152 | 82 | 6 | 53 | 152 | 38 | 603 | 15112 | 14695 | 16534 |
| 36 | 150 | 79 | 7 | 60 | 130 | 41 | 525 | 11882 | 13556 | 15201 |
| 37 | 138 | 94 | 6 | 58 | 130 | 40 | 602 | 17474 | 14680 | 16517 |
| 38 | 178 | 56 | 7 | 68 | 119 | 66 | 605 | 15095 | 14724 | 16569 |
| 39 | 172 | 80 | 10 | 65 | 130 | 43 | 558 | 14296 | 14038 | 15765 |
| 40 | 165 | 86 | 8 | 102 | 152 | 35 | 635 | 15968 | 15162 | 17082 |
| 41 | 156 | 86 | 8 | 70 | 156 | 32 | 605 | 16005 | 14724 | 16569 |
| 42 | 135 | 102 | 18 | 85 | 145 | 40 | 523 | 14256 | 13527 | 15166 |
| 43 | 142 | 98 | 8 | 95 | 135 | 35 | 710 | 17856 | 16257 | 18364 |

Underlines indicate that values are outside the scope of the present invention.

For each of the obtained steel sheets, the area fractions of metallographic structures, the average grain size, and the total grain boundary number density of solute C and solute B at a ¼ depth position of the sheet thickness from the surface of the steel sheet and the pole density of each crystal orientation at the thickness middle portion were obtained by the above-described methods. It should be noted that, in the measurement of the pole density of the crystal orientation at the thickness middle portion, the grain orientation information of approximately 3000 to 8000 bcc grains was measured.

In order to evaluate the mechanical properties of the obtained steel sheets, the tensile strength TS (MPa) and the total elongation at fracture El (%) were evaluated with a No. 5 test piece according to JIS Z 2241:2011. The stretch flangeability was evaluated with the limiting hole expansion ratio λ (%) that was measured according to JIS Z 2256:2010. The low temperature toughness was evaluated with the fracture appearance transition temperature vTrs (° C.) and evaluated by performing a Charpy impact test using a V-notch test piece obtained by working the steel sheet into a 2.5 mm sub-size test piece according to JIS Z 2242:2005. For the evaluation of the peeling resistance, three holes were punched in the steel sheet by the method described in JIS Z 2256:2010, and the presence or absence of the occurrence of peeling was visually confirmed.

Table 3A and Table 3B show the test results of the metallographic structures, the textures, and the mechanical properties. It should be noted that, in the 'plating' columns of Table 3 and Table 3B, GI indicates a hot-dip galvanized layer and GA indicates a hot-dip galvannealed layer.

In the case of 780 MPa or more, the tensile strength was regarded as a high strength and determined as pass, and, when the vTrs (C) was −40° C. or lower, the low temperature toughness was regarded as excellent and determined as pass. The workability was evaluated with the balance between the strength and the total elongation at fracture (TS×El) and the balance between the strength and the stretch flangeability (TS×λ). In a case where TS×El (MPa·%) was 12000 MPa % or more, the strength was regarded as high, and the elongation was regarded as excellent and determined as pass. In a case where TS×λ (MPa·%) was 50000 MPa·% or more, the strength was regarded as high, and the stretch flangeability was regarded as excellent and determined as pass. In a case where peeling occurred, 'Bad' is indicated in the tables, and, in a case where there was no peeling, the peeling resistance was determined as pass, and 'Good' is indicated in the tables.

TABLE 3A

| Steel sheet No. | Steel | Area fraction of tempered bainite + tempered martensite (%) | Area fraction of ferrite (%) | Area fraction of residual γ (%) | Area fraction of pearlite, fresh martensite, and cementite (%) | Average grain size (μm) | {211} <011> + {332} <113> | Solute C + B (solutes/nm$^2$) |
|---|---|---|---|---|---|---|---|---|
| 1 | A | 76 | 21 | 0 | 3 | 5.4 | 8.6 | 6.0 |
| 2 | A | 73 | 26 | 1 | 0 | 6.7 | 3.4 | 6.2 |
| 3 | A | 65 | 32 | 0 | 3 | 10.5 | 4.5 | 6.0 |
| 4 | A | 74 | 23 | 0 | 3 | 8.6 | 4.0 | 6.0 |
| 5 | A | 69 | 30 | 0 | 1 | 5.4 | 6.5 | 6.0 |
| 6 | A | 65 | 34 | 0 | 1 | 5.4 | 6.3 | 3.3 |
| 7 | A | 70 | 28 | 1 | 1 | 6.8 | 6.1 | 7.0 |
| 8 | A | 84 | 15 | 0 | 1 | 15.6 | 10.9 | 6.3 |
| 9 | A | 94 | 6 | 0 | 0 | 5.0 | 12.5 | 5.5 |
| 10 | A | 34 | 62 | 1 | 3 | 5.4 | 12.2 | 5.7 |
| 11 | A | 60 | 39 | 0 | 1 | 6.8 | 7.8 | 0.8 |
| 12 | B | 96 | 0 | 4 | 0 | 6.0 | 4.1 | 4.5 |
| 13 | C | 73 | 25 | 0 | 2 | 5.6 | 4.8 | 3.8 |
| 14 | D | 58 | 20 | 0 | 22 | 6.9 | 5.4 | 3.5 |
| 15 | E | 61 | 36 | 0 | 3 | 5.2 | 4.0 | 3.2 |
| 16 | E | 11 | 75 | 2 | 12 | 4.6 | 5.5 | 1.2 |
| 17 | F | 77 | 23 | 0 | 0 | 4.7 | 5.4 | 3.3 |
| 18 | G | 70 | 28 | 0 | 2 | 4.5 | 4.5 | 4.6 |
| 19 | H | 59 | 39 | 0 | 2 | 5.6 | 2.4 | 4.6 |
| 20 | I | 64 | 35 | 0 | 1 | 5.0 | 4.5 | 4.1 |
| 21 | J | 98 | 2 | 0 | 0 | 4.9 | 4.8 | 3.4 |

| Steel sheet No. | TS (MPa) | El (%) | TS × El (MPa %) | λ (%) | TS × λ (MPa %) | vTrs (° C.) | Peeling | Plating | Note |
|---|---|---|---|---|---|---|---|---|---|
| 1 | 999 | 13.7 | 13686 | 57 | 57135 | −78 | Good | GI | Invention Example |
| 2 | 1010 | 14.3 | 14394 | 68 | 68208 | −71 | Good | GI | Invention Example |
| 3 | 990 | 14.0 | 13860 | 65 | 64350 | −45 | Good | None | Invention Example |
| 4 | 1008 | 14.8 | 14963 | 82 | 82339 | −58 | Good | GA | Invention Example |
| 5 | 994 | 15.4 | 15308 | 72 | 71568 | −76 | Good | GI | Invention Example |
| 6 | 960 | 16.2 | 15552 | 71 | 68205 | −74 | Good | GA | Invention Example |
| 7 | 1015 | 14.6 | 14819 | 68 | 69020 | −60 | Good | GI | Invention Example |
| 8 | 1018 | 13.2 | 13438 | 24 | 24242 | −5 | Good | GA | Comparative Example |
| 9 | 1048 | 17.2 | 18026 | 25 | 26200 | −61 | Good | GA | Comparative Example |
| 10 | 902 | 16.2 | 14612 | 26 | 23452 | −22 | Good | GA | Comparative Example |
| 11 | 857 | 15.5 | 13256 | 47 | 40279 | −32 | Bad | GA | Comparative Example |
| 12 | 1054 | 8.7 | 9170 | 45 | 47430 | −20 | Good | GA | Comparative Example |
| 13 | 995 | 15.3 | 15250 | 73 | 72284 | −68 | Good | GA | Invention Example |
| 14 | 1221 | 8.7 | 10623 | 22 | 26862 | 15 | Good | GA | Comparative Example |
| 15 | 1033 | 15.5 | 15982 | 76 | 78078 | −87 | Good | GA | Invention Example |
| 16 | 784 | 17.5 | 13720 | 53 | 41552 | −12 | Good | GA | Comparative Example |
| 17 | 1073 | 14.1 | 15178 | 75 | 80424 | −82 | Good | GA | Invention Example |
| 18 | 1052 | 14.7 | 15500 | 81 | 85096 | −83 | Good | GA | Invention Example |
| 19 | 969 | 13.7 | 13275 | 34 | 32946 | −6 | Good | GA | Comparative Example |
| 20 | 985 | 16.0 | 15800 | 93 | 91917 | −83 | Good | GA | Invention Example |
| 21 | 1015 | 16.0 | 16235 | 62 | 62903 | −62 | Good | GA | Invention Example |

Underlines indicate that values are outside the scope of the present invention and property values are insufficient

TABLE 3B

| Steel sheet No. | Steel | Area fraction of tempered bainite + tempered martensite (%) | Area fraction of ferrite (%) | Area fraction of residual γ (%) | Area fraction of pearlite, fresh martensite, and cementite (%) | Average grain size (μm) | {211} <011> + {332} <113> | Solute C + B (solutes/nm$^2$) |
|---|---|---|---|---|---|---|---|---|
| 22 | J | 99 | 0 | 0 | 1 | 4.6 | 6.0 | 6.9 |
| 23 | K | 70 | 30 | 0 | 0 | 4.5 | 5.5 | 4.5 |
| 24 | L | 73 | 26 | 1 | 0 | 5.6 | 4.9 | 4.3 |
| 25 | L | 46 | 49 | 5 | 0 | 5.4 | 5.2 | 8.5 |

TABLE 3B-continued

| | | | | | | | | |
|---|---|---|---|---|---|---|---|---|
| 26 | L | 48 | 51 | 0 | 1 | 5.1 | 5.0 | 0.4 |
| 27 | M | 60 | 36 | 0 | 4 | 4.2 | 5.1 | 4.6 |
| 28 | N | 97 | 1 | 1 | 1 | 5.8 | 6.4 | 5.7 |
| 29 | N | 84 | 14 | 1 | 1 | 5.5 | 13.4 | 5.9 |
| 30 | O | 75 | 21 | 0 | 4 | 6.1 | 5.0 | 5.5 |
| 31 | P | 2 | 85 | 0 | 13 | 6.4 | 5.1 | 5.5 |
| 32 | Q | 57 | 40 | 0 | 3 | 4.3 | 5.1 | 4.6 |
| 33 | R | 74 | 23 | 0 | 3 | 4.8 | 6.0 | 4.6 |
| 34 | S | 64 | 32 | 0 | 4 | 4.4 | 5.9 | 4.0 |
| 35 | T | 81 | 13 | 0 | 6 | 4.4 | 5.9 | 4.4 |
| 36 | T | 83 | 10 | 4 | 3 | 6.2 | 4.6 | 4.4 |
| 37 | T | 84 | 14 | 0 | 2 | 5.8 | 5.1 | 0.3 |
| 38 | U | 64 | 33 | 1 | 2 | 4.5 | 5.7 | 4.3 |
| 39 | V | 52 | 48 | 0 | 0 | 7.5 | 8.2 | 5.5 |
| 40 | A | 44 | 55 | 0 | 1 | 4.3 | 4.6 | 4.2 |
| 41 | A | 73 | 26 | 0 | 1 | 8.1 | 2.9 | 4.5 |
| 42 | A | 16 | 84 | 0 | 0 | 6.2 | 5.6 | 5.3 |
| 43 | A | 64 | 36 | 0 | 0 | 6.7 | 5.3 | 9.1 |

| Steel sheet No. | TS (MPa) | El (%) | TS × El (MPa %) | λ (%) | TS × λ (MPa %) | vTrs (° C.) | Peeling | Plating | Note |
|---|---|---|---|---|---|---|---|---|---|
| 22 | 1048 | 13.6 | 14200 | 64 | 67072 | −68 | Good | | Invention Example |
| 23 | 989 | 15.3 | 15132 | 68 | 67252 | −83 | Good | GA | Invention Example |
| 24 | 999 | 15.8 | 15784 | 73 | 72927 | −70 | Good | GA | Invention Example |
| 25 | 1036 | 12.5 | 12991 | 38 | 39368 | −20 | Good | | Comparative Example |
| 26 | 859 | 15.2 | 13057 | 42 | 36078 | −25 | Bad | GA | Comparative Example |
| 27 | 961 | 14.6 | 14031 | 78 | 74565 | −82 | Good | GI | Invention Example |
| 28 | 1225 | 12.9 | 15803 | 52 | 63700 | −43 | Good | GA | Invention Example |
| 29 | 1105 | 10.5 | 11603 | 18 | 19890 | −25 | Good | GI | Comparative Example |
| 30 | 1175 | 13.0 | 15250 | 60 | 70198 | −61 | Good | GI | Invention Example |
| 31 | 720 | 20.5 | 14760 | 73 | 52560 | −39 | Good | GI | Comparative Example |
| 32 | 1022 | 15.7 | 16097 | 80 | 81762 | −80 | Good | GA | Invention Example |
| 33 | 1061 | 14.0 | 14854 | 61 | 64721 | −84 | Good | GA | Invention Example |
| 34 | 1102 | 14.2 | 15700 | 70 | 76983 | −79 | Good | GA | Invention Example |
| 35 | 1127 | 14.1 | 15889 | 69 | 77393 | −82 | Good | GI | Invention Example |
| 36 | 1058 | 11.5 | 12167 | 42 | 44436 | −37 | Good | GA | Comparative Example |
| 37 | 964 | 13.2 | 12725 | 35 | 33740 | −25 | Bad | GA | Comparative Example |
| 38 | 973 | 15.2 | 14757 | 75 | 72538 | −82 | Good | GA | Invention Example |
| 39 | 824 | 19.2 | 15821 | 85 | 70040 | −80 | Good | GA | Invention Example |
| 40 | 995 | 16.5 | 16418 | 60 | 59700 | −75 | Good | GA | Invention Example |
| 41 | 1025 | 17.2 | 17630 | 59 | 60475 | −55 | Good | GA | Invention Example |
| 42 | 811 | 21.2 | 17193 | 76 | 61636 | −64 | Good | GA | Invention Example |
| 43 | 905 | 15.6 | 14118 | 68 | 61540 | −64 | Good | | Invention Example |

Underlines indicate that values are outside the scope of the present invention and property values are insufficient.

According to Table 3A and Table 3B, it is found that the, in the steel sheets (invention examples) according to the present embodiment, the strength was high, the low temperature toughness, the elongation, and the stretch flangeability were excellent, and peeling did not occur. On the other hand, it is found that, in the comparative examples, any one or more properties were poor.

INDUSTRIAL APPLICABILITY

According to the aspects of the present invention, it is possible to provide a steel sheet having a high strength and being excellent in terms of elongation, stretch flangeability, low temperature toughness, and peeling resistance, a method for manufacturing the same, and a plated steel sheet having a variety of characteristics described above. When the steel sheet or plated steel sheet according to the present invention is used as a material of a component for an inner plate member, a structural member, a suspension member, or the like of a car, it is easy to work the steel sheet or plated steel sheet into a component shape, and the steel sheet or plated steel sheet is capable of withstanding the use in an extremely cold climate, and thus industrial contribution is extremely significant.

The invention claimed is:

1. A steel sheet having a chemical composition containing, by mass %:

C: 0.02% to 0.15%,
Si: 0.005% to 2.000%,
Mn: 1.00% to 3.00%,
Ti: 0.010% to 0.200%,
sol. Al: 0.001% to 1.000%,
N: 0.0010% to 0.0100%,
P: 0.100% or less,
S: 0.0100% or less,
Nb: 0% to 0.100%,
V: 0% to 0.500%,
Mo: 0% to 0.500%,
Cu: 0% to 1.00%,
Ni: 0% to 1.00%,
Cr: 0% to 2.00%,
B: 0% to 0.0020%,
Ca: 0% to 0.0100%,
Mg: 0% to 0.0100%,
REM: 0% to 0.0100%, and
Bi: 0% to 0.0200% with a remainder comprising Fe and an impurity, wherein, at a ¼ depth position of a sheet thickness from a surface, a total area fraction of tempered martensite and tempered bainite is 10% or more and 79% or less, an area fraction of ferrite is 21% or more and 90% or less, an area fraction of residual austenite is 0% or more and less than 4%, a total area fraction of the residual austenite, fresh martensite, cementite, and pearlite is 0% or more and 10% or less, an average grain size is 15.0 μm or less, a total grain boundary number density of solute C and solute B is 1.0 solute/$nm^2$ or more and 12.0 solutes/$nm^2$ or less, a total of pole densities of {211}<011> and {332}<113> in a thickness middle portion is 12.0 or less, and a tensile strength is 780 MPa or more.

2. The steel sheet according to claim 1, wherein the chemical composition contains, by mass %, one or more of Nb: 0.001% to 0.100%, V: 0.005% to 0.500%, Mo: 0.001% to 0.500%, Cu: 0.02% to 1.00%, Ni: 0.02% to 1.00%, Cr: 0.02% to 2.00%, B: 0.0001% to 0.0020%, Ca: 0.0002% to 0.0100%, Mg: 0.0002% to 0.0100%, REM: 0.0002% to 0.0100%, and Bi: 0.0001% to 0.0200%.

3. A method for manufacturing the steel sheet according to claim 1 or 2, the method comprising:

a step of performing multi-pass hot rolling on a slab or steel piece having the chemical composition according to claim 1 or 2 using a plurality of rolling stands, and a step of performing a heat treatment, wherein, in the step of performing multi-pass hot rolling, a heating temperature is set to 1200° C. to 1350° C., when a finish temperature is expressed as FT in a unit of ° C., a total rolling reduction in a temperature range of higher than the FT+50° C. and the FT+150° C. or lower is set to 50% or more, a total rolling reduction within a temperature range of from the FT to the FT+50° C. is set to 40% to 80%, a time necessary for rolling within the temperature range of from the FT to the FT+50° C. is set to 0.5 to 10.0 seconds, two or more passes of rolling are performed in each of the temperature range of higher than the FT+50° C. and the FT+150° C. or lower and the temperature range of from the FT to the FT+50° C., an average cooling rate within a temperature range of from the FT to the FT+100° C. is set to 6.0° C./sec or faster, finish rolling is completed with the FT set to equal to or higher than Ars that is obtained from Expression (1) and set to equal to or higher than TR that is obtained from Expression (2) and 1100° C. or lower, then, water cooling is initiated within 3.0 seconds, cooling is performed by setting an average cooling rate within a temperature range of from the FT to 750° C. to 30° C./sec or faster, retaining the slab or steel piece within a temperature range of from 750° C. to 600° C. for 20 seconds or shorter, and then setting an average cooling rate within a temperature range of from a cooling stop temperature of 600° C. to lower than Ms-200° C. to 30° C./sec or faster, in the step of performing the heat treatment, a maximum attainment temperature Tmax during the heat treatment is set to 300° C. to 720° C., and a tempering parameter Ps is set to 14.6×Tmax+5891 or more and 17.1×Tmax+6223 or less, $$Ar_3\ (°\ C.)=901-325\times[C]+33\times[Si]-92\times[Mn]+287\times[P]+40\times[sol.\ Al] \quad (1)$$

$$TR\ (°\ C.)=800+700\times[Ti]+1000\times[Nb] \quad (2)$$

here, each element symbol in Expression (1) and Expression (2) indicates an amount of each element by mass %, and zero is assigned in a case where the element is not contained.

4. The method for manufacturing a steel sheet according to claim 3, wherein, in the step of performing multi-pass hot rolling, an average cooling rate within a temperature range of from the cooling stop temperature of Ms that is obtained from Expression (3) to lower than Ms-200° C. is set to 80° C./sec or faster, $$Ms\ (°\ C.)=561-474\times[C]-33\times[Mn]-17\times[Ni]-21\times[Mo] \quad (3)$$

here, each element symbol in Expression (3) indicates an amount of each element by mass %, and zero is assigned in a case where the element is not contained.

5. The method for manufacturing a steel sheet according to claim 3, wherein, in the step of performing multi-pass hot rolling, the water cooling is initiated within 0.3 seconds after completion of the finish rolling, and cooling in which an average cooling rate within a temperature range of from the FT to the FT-40° C. is 100° C./sec or faster is performed.

6. The method for manufacturing a steel sheet according to claim 5, wherein, in the step of performing multi-pass hot rolling, a step of performing cooling in which an average cooling rate within a temperature range from the FT to the FT−40° C. is 100° C./sec or faster is performed between the rolling stands.

7. A plated steel sheet comprising:

the steel sheet according to claim 1 or 2; and a plating layer formed on a surface of the steel sheet.

8. The plated steel sheet according to claim 7, wherein the plating layer is a hot-dip galvanized layer.

9. The plated steel sheet according to claim 7, wherein the plating layer is a hot-dip galvannealed layer.

10. The method for manufacturing a steel sheet according to claim 4, wherein, in the step of performing multi-pass hot rolling, the water cooling is initiated within 0.3 seconds after completion of the finish rolling, and cooling in which an average cooling rate within a temperature range of from the FT to the FT−40° C. is 100° C./sec or faster is performed.

* * * * *